US007201274B2

(12) United States Patent
Paliotta et al.

(10) Patent No.: US 7,201,274 B2
(45) Date of Patent: Apr. 10, 2007

(54) SIMULTANEOUS STOP, ALIGNMENT, AND ENHANCED TAMPER-RESISTANT FEATURE OF A PHARMACEUTICAL SLIDE PACKAGE

(75) Inventors: Michael Paliotta, Horseheads, NY (US); George Howell, Elmira, NY (US)

(73) Assignee: Howell Packaging division of FM Howell & Co., Elmira, NY (US)

( * ) Notice: Subject to any disclaimer, the term of this patent is extended or adjusted under 35 U.S.C. 154(b) by 285 days.

(21) Appl. No.: 10/880,464

(22) Filed: Jul. 1, 2004

(65) Prior Publication Data

US 2004/0232033 A1 Nov. 25, 2004

Related U.S. Application Data

(63) Continuation-in-part of application No. 10/226,312, filed on Aug. 23, 2002, now Pat. No. 6,848,580.

(51) Int. Cl.
*B65D 83/04* (2006.01)

(52) U.S. Cl. ..... 206/531; 206/538

(58) Field of Classification Search ..... 206/531, 206/532, 536, 538, 528, 530, 828, 539
See application file for complete search history.

(56) References Cited

U.S. PATENT DOCUMENTS

| | | | | |
|---|---|---|---|---|
| 2,411,471 | A | 11/1946 | Sherman | |
| 2,971,638 | A | 2/1961 | Allison et al. | |
| 3,610,410 | A | 10/1971 | Seeley | |
| 3,812,963 | A | 5/1974 | Zahuranec et al. | |
| 3,921,804 | A | 11/1975 | Tester | |
| 5,150,793 | A | 9/1992 | Tannenbaum | |
| 5,244,091 | A | 9/1993 | Tannenbaum | |
| 5,323,907 | A | 6/1994 | Kalvelage | |
| 5,383,556 | A | 1/1995 | Van Loo | |
| 5,915,559 | A | 6/1999 | Hulick et al. | |
| 6,047,829 | A | 4/2000 | Johnstone et al. | |
| 6,138,830 | A | 10/2000 | Muggli | |
| 6,338,408 | B1 | 1/2002 | Anderson | |
| 6,484,580 | B2 * | 11/2002 | Eagen et al. | 206/531 |
| 6,637,431 | B2 | 10/2003 | Ekelius et al. | |
| 6,659,280 | B2 * | 12/2003 | Paliotta et al. | 206/531 |
| 6,675,972 | B2 * | 1/2004 | Patterson | 206/531 |
| 6,874,636 | B2 * | 4/2005 | Paliotta et al. | 206/531 |
| 6,896,138 | B2 * | 5/2005 | Rock et al. | 206/531 |
| 6,951,282 | B2 * | 10/2005 | Jones | 206/469 |
| 7,000,768 | B2 * | 2/2006 | Morita et al. | 206/531 |

* cited by examiner

*Primary Examiner*—Shian T. Luong
(74) *Attorney, Agent, or Firm*—Arent Fox PLLC

(57) ABSTRACT

A package having a simultaneous stop, alignment, and enhanced tamper-resistant feature, wherein the package has an outer sleeve and a slide card slidably disposed within the outer sleeve. A stop panel is disposed on an inside surface of the outer sleeve and has an extension panel extending away therefrom, wherein the extension panel enhances the tamper-resistant nature of the package. A guide panel extends along a longitudinal edge of the outer sleeve and has a length equal to or greater than a combined length of the stop panel and extension panel. The guide panel being folded over the extension panel to defined a channel between an edge of the guide panel and a score line separating first and second panels of the outer sleeve.

36 Claims, 20 Drawing Sheets

SIMULTANEOUS STOP, ALIGNMENT, AND ENHANCED TAMPER-RESISTANT FEATURE OF A PHARMACEUTICAL SLIDE PACKAGE

CROSS-REFERENCE TO RELATED APPLICATION

This application is a continuation-in-part of non-provisional patent application Ser. No. 10/226,312, which was filed on Aug. 23, 2002 now U.S. Pat. No. 6,848,580.

BACKGROUND OF THE INVENTION

1. Field of the Invention

This invention relates to a blister package having a stop, align, and enhanced tamper-resistant feature that stops the sliding movement of a slide card within an outer sleeve, simultaneously aligns the apertures of the slide card with the apertures of the outer sleeve so that articles retained by the blister pockets can be removed from the package, and enhances the tamper-resistant nature of the package.

2. Description of Related Art

It is common practice to use blister packages to package small solid articles or products which may be dispensed from the package by applying pressure to the blister to force the article or product from an individual blister or capsule through a rupturable membrane. Since this type of packaging is typically used for marketing medicines, the invention will be referred to herein with respect to a package particularly suitable for such use, but it should be understood that the package may be used for other products as well. Recently, a substantial effort has been directed toward providing packaging that contains sufficient impediments to prevent children from easily opening the package and gaining access to the package articles or products while still providing adults with easy access to the articles or products contained therein.

For example, U.S. Pat. No. 6,047,829 to Johnstone et al. (hereinafter "Johnstone") discloses a unit dose package having an outer sleeve blank 2 and inner slide card blank 100. As shown in FIGS. 1–3 of the Johnstone patent, the outer sleeve blank 2 has extension panels 4 and 8. Extension panel 4 is folded over and adhesively attached to extension panel 8. Extension panel 8 is then folded over side panel 10. As shown in FIGS. 6–9 of the Johnstone patent, the inner slide card blank 100 has an extension panel 106 that is folded over side panel 102.

Once fully assembled, a user can pull the inner slide card 100 within the outer sleeve 50 formed by the outer sleeve blank 2 until the extension 106 of the inner slide card 100 is caught and retained by the folded extension panels 4 and 8 of the outer sleeve 50. Folded extension panels 4 and 8 of the outer sleeve 50 and extension panel 106 of the inner slide card 100, which form the locking means of the Johnstone unit dose package, prevent the inner slide card from being completely removed from the outer sleeve 50.

However, the locking means 4, 8, and 106 of the Johnstone unit dose package does not align the holes within the slide card 100 with the blisters of the blister package while simultaneously retaining the sliding card from being removed from the package. Put simply, the Johnstone unit dose package does not provide a stop feature that retains the inner slide card 100 within the outer sleeve 50 while simultaneously aligning the holes within the slide card 100 with the blisters of the blister package.

In another example, U.S. Pat. No. 5,150,793 to Tannenbaum discloses a device for inhibiting the removal of an article from a blister type container 14 positioned within a housing 32 in manner such that the container 14 may slide in a left-to-right direction when viewing FIG. 2*a* of the Tannenbaum patent. The container 14 slides between a dispensing position, as shown in FIG. 2*b*, in which articles 12 may be removed from the container 14, and a non-dispensing position as shown in FIG. 2*a*, which prevents removal of the articles 12 from the container 14.

The Tannenbaum container includes a base 34 of the housing 32 that has openings 36 which are in registry with the blisters 22 of the container 14. The housing 32 includes a biasing means and a first enclosure 38 having an abutment 42 that contacts a portion 44 of the outer surface 23 of the blister. As shown in FIG. 3 of Tannenbaum, the biasing means has a first end 48 and folds 54 that form a spring member 52.

The biasing means is positioned within the first enclosure 38 of the housing 32. See FIGS. 2*a* and 2*b* of Tannenbaum. When the container 14 is slid within the housing 32 in a left-to-right direction as shown in FIG. 2*a*, the folds 54 of the biasing means are compressed as shown in FIG. 2*b*, and the blisters 22 are aligned with the openings 36 in the base 34 of the housing 32 to facilitate removal of the articles. The sliding motion of the container 14 within the housing 32 is stopped when the abutment 42 of the first enclosure 38 engages the outer surface 23 of the blister 22. However, the Tannenbaum package does not disclose a slide card positioned between the container 14 and the openings 36 in the base 34 and having a stop feature that engages a stop feature on an inside surface of the housing 32 that aligns the holes in the container 14 with the openings 36 while simultaneously stopping the container 14 from sliding any further within the housing 32.

In the Applicants' co-pending patent application Ser. No. 10/226,312, a pharmaceutical slide package is provided with a feature that aligns holes of a slide card within the package with blisters contained in blister packaging attached to the package while simultaneously preventing the slide card from further movement. The package includes a first component that is a sliding card contained within a second component or outer sleeve. A sealed blister package is attached to an interior of the outer sleeve. The slide card is then inserted in the outer sleeve, which is then folded and sealed, thereby securing the slide card therein.

A stop feature, integrally formed within the outer sleeve and slide card, limits the sliding range of the slide card within the outer sleeve. An aspect of the stop feature is that the holes within the slide card are aligned with the pill blisters in the blister package at the point where the stop feature stops the slide card from further movement within the outer sleeve. The stop feature includes the raised edge of the folded panel on the slide card which engages a corresponding edge on the inside of the outer sleeve. When the holes on the slide card are aligned with the blisters of the blister packaging, a user can push an article contained in the blister packaging through a hole in the foil backing on the back side surface of the blister packaging, through a hole in the slide card, and out a corresponding hole in the back of the outer sleeve of the package. When the slide card is returned to a start or free position, the holes in the back side surface of the blister packaging are blocked, and the articles contained in the blister packaging cannot be removed.

A stop feature that limits the movement of the slide card within the package provides the child-resistant feature. The sliding movement of the slide card within the package stops when a raised edge of a folded panel on the slide card engages an edge on the inside of the outer sleeve. At the same time or simultaneous with the sliding movement of the slide card within the package being stopped by the stop feature, the holes on the slide card are aligned with corresponding blisters in the blister packaging so that a user can push the article contained within the blister packaging out of the back of the package. When the slide card is returned to the start or free position, the exit holes in the package are blocked, thereby offering resistance to children accessing the pills. The holes on the back of the package are formed by non-continuous cut lines such that the package remains intact and the portions delimited by the cut lines are removed or punctured when the article exits the package. This feature also makes it difficult for a child to pick at the package and remove the articles therefrom. As the slide card is secured in the package on all four sides, the ability of the child to pick and tear the package is substantially reduced.

Applicants, upon testing of the package, have determined there is a need for the tamper-resistant nature of the package to be further enhanced to deter and prevent children from accessing the contents of the package.

SUMMARY OF THE INVENTION

It is an object of this invention to at least overcome the above-discussed drawbacks of the conventional child-resistant packages and dispensers.

Another object of this invention is to provide a unique child-resistant blister package that is child resistant and senior citizen friendly.

Yet another object of this invention is to provide a pharmaceutical slide package having a feature that aligns holes of a slide card within the package with blisters contained in blister packaging attached to the package while simultaneously preventing the slide card from further movement and enhancing the tamper-resistant nature of the package.

The package includes a first component that is a sliding card contained within a second component or outer sleeve. A sealed blister package is attached to an interior of the outer sleeve. The slide card is then inserted in the outer sleeve, which is then folded and sealed, thereby securing the slide card therein.

A stop feature, integrally formed within the outer sleeve and slide card, limits the sliding range of the slide card within the outer sleeve. An aspect of the stop feature is that the holes within the slide card are aligned with the pill blisters in the blister package at the point where the stop feature stops the slide card from further movement within the outer sleeve. The stop feature includes the raised edge of the folded panel on the slide card which engages a corresponding edge on the inside of the outer sleeve.

When the holes on the slide card are aligned with the blisters of the blister packaging, a user can push an article contained in the blister packaging through a hole in the foil backing on the back side surface of the blister packaging, through a hole in the slide card, and out a corresponding hole in the back of the outer sleeve of the package. When the slide card is returned to a start or free position, the holes in the back side surface of the blister packaging are blocked, and the articles contained in the blister packaging cannot be removed.

A stop feature that limits the movement of the slide card within the package provides the child-resistant feature. The sliding movement of the slide card within the package stops when a raised edge of a folded panel on the slide card engages an edge on the inside of the outer sleeve. At the same time or simultaneous with the sliding movement of the slide card within the package being stopped by the stop feature, the holes on the slide card are aligned with corresponding blisters in the blister packaging so that a user can push the article contained within the blister packaging out of the back of the package.

When the slide card is returned to the start or free position, the exit holes in the package are blocked, thereby offering resistance to children accessing the pills. The holes on the back of the package are formed by non-continuous cut lines such that the package remains intact and the portions delimited by the cut lines are removed or punctured when the article exits the package. This feature also makes it difficult for a child to pick at the package and remove the articles therefrom. As the slide card is secured in the package on all four sides, the ability of the child to pick and tear the package is substantially reduced.

An extension panel of a stop panel provides additional thickness to the package while also permitting the sliding card to slide more easily within the outer sleeve. The stop panel may be integrally formed on the outer sleeve or attached thereto. Likewise, the extension panel may be integrally formed on the stop panel or attached thereto.

A lock feature may also be provided that prevents any sliding of the slide card until the lock is disengaged. Once the lock is disengaged, then the slide card may be slid within the outer sleeve until the stop and align feature stops the sliding movement and simultaneously aligns the apertures so the articles may be removed from the package.

A cover may also be provided that contains indicia that would be ornamental and/or informative in nature.

BRIEF DESCRIPTION OF THE DRAWINGS

Other objects and features of this invention will be better understood from the following description, with reference to the accompanying drawings, wherein.

DETAILED DESCRIPTION OF THE PREFERRED EMBODIMENTS

Figure 1:
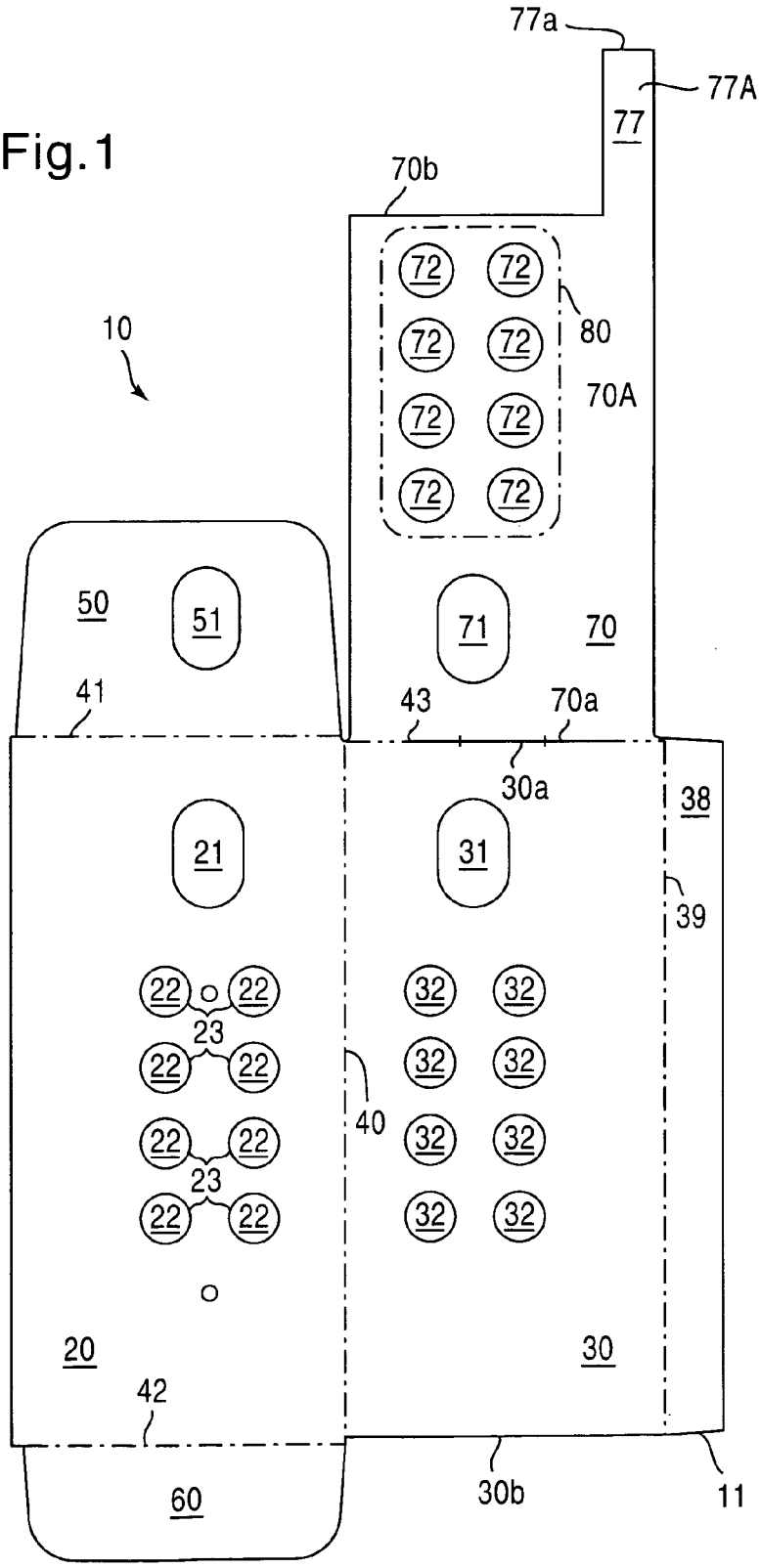
FIG. 1 is a top view of a disassembled outer sleeve of the package according to a preferred embodiment of the invention.

Referring to FIG. 1, the outer sleeve 10 of the package 1 is formed from a flat, substantially rectangular-shaped single blank 11, ideally made from paperboard. However, it is within the scope of this invention to use any suitable material well known or later developed in the art, such as, for example, paper, plastic, metal, natural or man-made, and the like. Furthermore, although not illustrated but well understood in the art, it is within the scope of this invention to use any suitable geometric shape, such as, for example, square, trapezoidal, circular, oval, and the like to form the outer sleeve 10.

The outer sleeve 10 includes a first panel 20 separated from a second panel 30 by a score line 40. The score line 40 enables the second panel 30 to be folded over the first panel 20 as will be explained in further detail below. Score line 41 delimits a first flap 50 of the first panel 20 while score line 42 delimits a second flap 60 of the first panel. Score lines 41 and 42 enable the first and second flaps 50 and 60, respectively, to be folded over the second panel 30 as will be explained in further detail below. The second panel 30 is separated from a guide panel 38 by a score line 39. The guide panel 38 defines a guiding channel C (See FIG. 3) for guiding an inner slide card 100 (See FIGS. 6–8) therethrough when folded over the score line 39, as will be described in further detail below.

The first panel 20 includes a gripping aperture 21 sized and configured to permit a user of the package 1 to have access to the slide card 100 contained in the outer sleeve 10, as will be explained in further detail below. The gripping aperture 21 is shown as being oval, but it is within the scope of this invention to configure the gripping aperture 21 to be of any suitable geometric shape that will provide the user access to the slide card 100. For example, although not illustrated, one of ordinary skill in the art would readily comprehend that the gripping aperture could be square, rectangular, triangular, circular, trapezoidal, pentagon-shaped, octagonal, and the like.

Furthermore, a plurality of exit apertures 22 are formed in the first panel 20, the exit apertures 22 being defined by non-continuous cut lines 23. Although two rows of four exit apertures 22 are shown being positioned relatively in the center of the first panel 20, it is within the scope of this invention to place any number of exit apertures 22 anywhere on the first panel 20 in as many or little rows as necessary. For example only, there could be one (See FIGS. 9–19), three, or more rows of any number of exit apertures 22 provided on the first panel 20.

The second panel 30, like the first panel 20, includes a gripping aperture 31 that is configured to coincide and overlap the gripping aperture 21 of the first panel 20. The second panel 30 also includes a plurality of blister pocket receiving apertures 32 that correspond to the number of exit apertures 22 in the first panel 20. The blister pocket receiving apertures 32 typically will contain blister packaging (not shown) that is well known in the art and is made from such materials as, for example only, clear plastic, foil, or the like. It should be noted that blister packaging is well known in the art and includes a backing that includes a foil portion (fp) (See FIGS. 2–3) through which each article must pass when being removed from the package 1.

The first flap 50 of the first panel 20 includes a gripping aperture 51 that is configured to coincide and overlap the gripping apertures 21 and 31 of the first and second panels 20 and 30, respectively.

Figure 2:
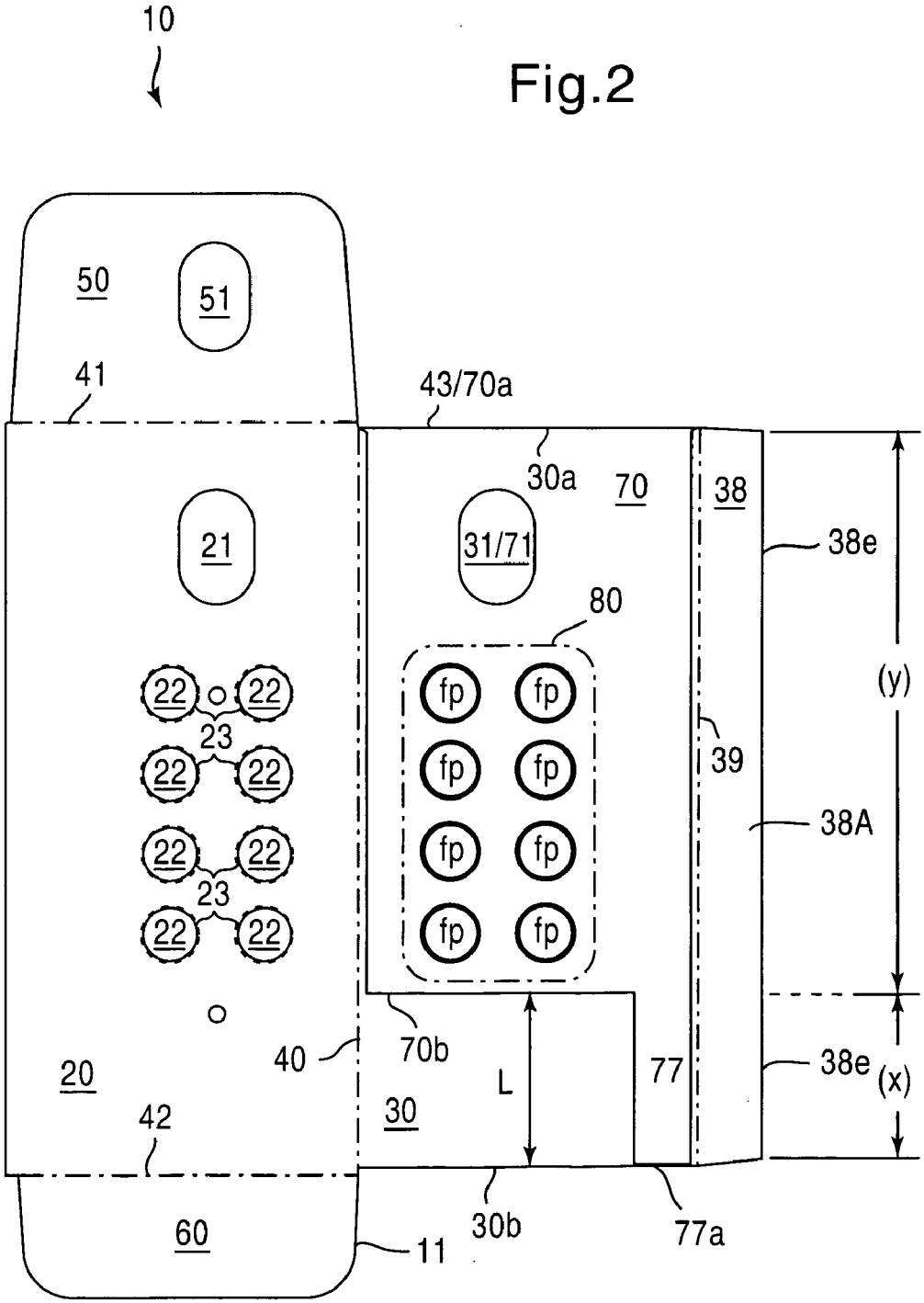
FIG. 2 is a top view of a stop panel and extension panel incorporated onto the second panel of the outer sleeve of FIG. 1.
Figure 3:
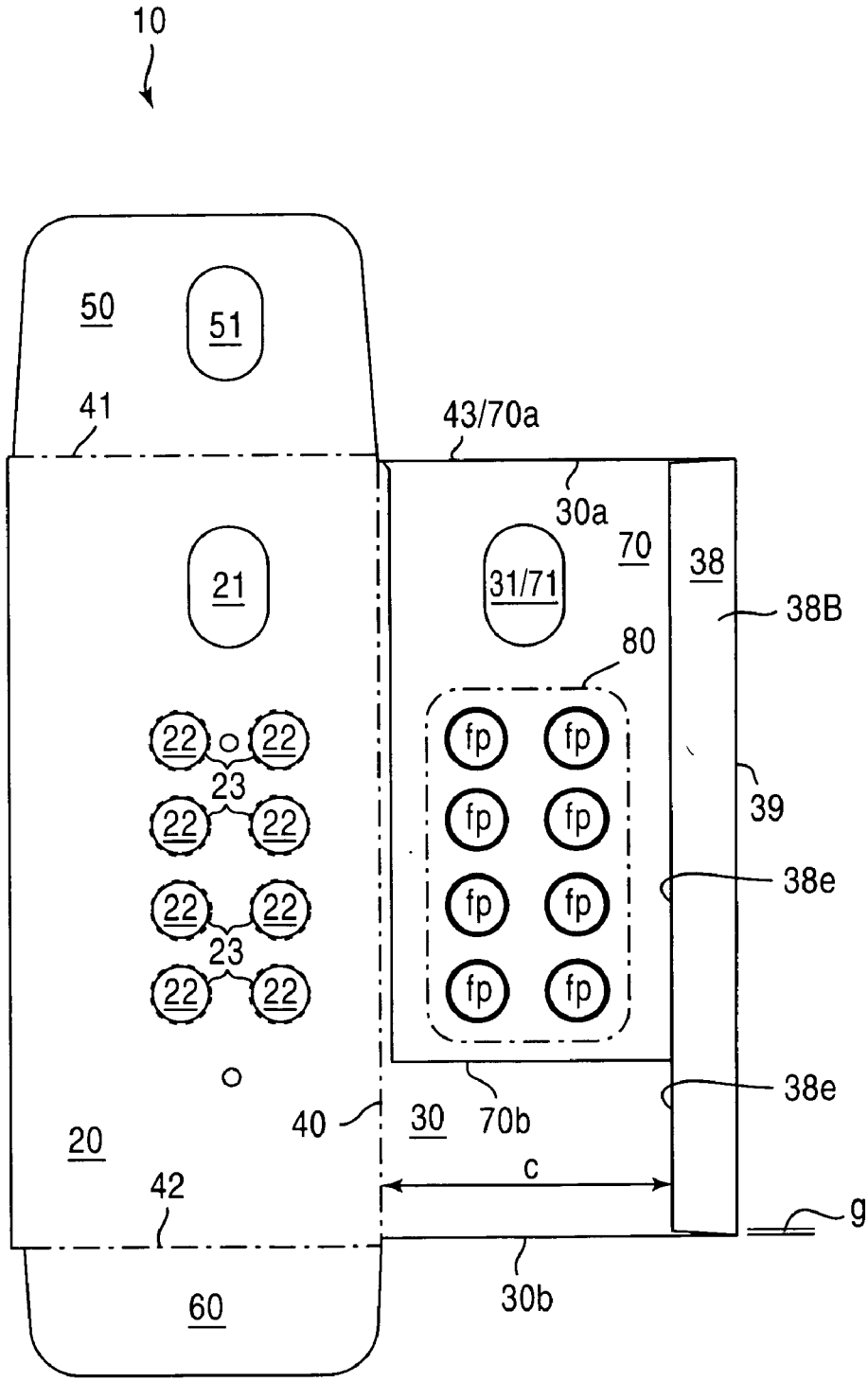
FIG. 3 is a top view of a guide panel folded over the extension panel of the outer sleeve of FIG. 2.

As shown in FIGS. 1–3, a stop panel 70 is attached or incorporated onto the second panel 30. In other words, it is within the scope of this invention to have the stop panel 70 be a separate panel attached or adhered to the second panel 30. In such a configuration, a first edge 70*a* of the stop panel 70 would not have to coincide with a first edge 30*a* of the second panel 30.

Alternatively, the stop panel 70 could be a flap of the second panel 30 that is delimited by a fold line 43 at a first edge 30*a* and 70*a* of the second panel 30 and stop panel 70, respectively, wherein the stop panel 70 is folded over the fold line 43 or first edge 30*a*/70*a* and adhered or otherwise permanently attached to the second panel 30. In other words, the first edge 70*a* of the stop panel 70 would coincide with the first edge 30*a* of the second panel, as shown in FIG. 2.

The stop panel 70 has a second edge 70*b* that is relatively parallel to, and remote from, the first edge 70*a*. The stop panel 70 also includes an extension panel 77 that extends away from the second edge 70*b* on a side of the stop panel 70 closest to the guide panel 38 (See FIG. 1). The extension panel 77 may be integral with the stop panel 70 as shown in FIG. 1, but it is also within the scope of the invention to attach the extension panel 77 to the stop panel 70.

The extension panel 77 includes an end 77*a* that is relatively parallel to, and remote from, the first and second edges 70*a* and 70*b*, respectively, of the stop panel 70. When the stop panel 70 is folded over fold line 43, the end 77*a* of the extension panel 77 may be proximate to, but not necessarily coincide with, a second edge 30*b* of the second panel 30. In other words, there may be a gap (g) (See FIG. 3) between the end 77*a* of the extension panel 77 and the second edge 30*b* of the second panel 30. Alternatively, it is within the scope of the invention to have the end 77*a* of the extension panel 77 coincide with the second edge 30*b* of the second panel 30 when the stop panel 70 is folded over fold line 43. In other words, there is no gap between the end 77*a* of the extension panel 77 and the second edge 30*b*.

Preferably, the extension panel 77 has a width that is less than a width of the guide panel 38 so that the extension panel 77 may be completely covered by the guide panel 38 when the guide panel 38 is folded over the score line 39, as will be described in further detail below. Moreover, the extension panel 77 increases the overall thickness and strength of the assembled package 1, as well as enhances the tamper-resistant nature of the package by making the package more rigid, stronger, and less susceptible to tearing and other such unauthorized or unintended access of the articles contained in the package 1.

Figure 3A:
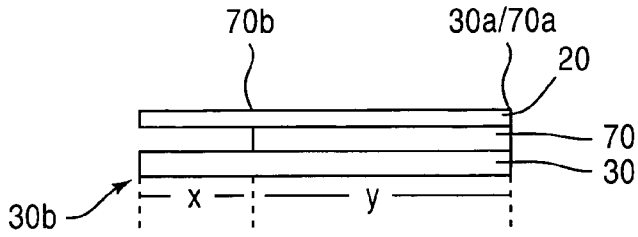
Fig.3A (Related Art)
FIG. 3A is a schematic diagram illustrating a side view of the guide panel folded over the stop panel.
Figure 3B:
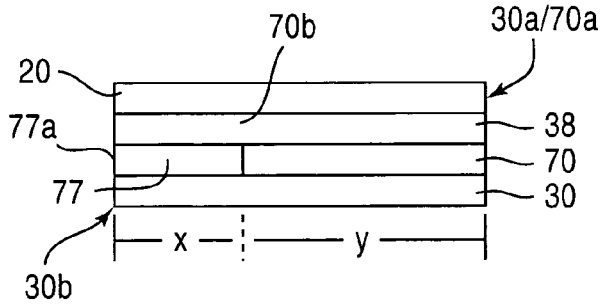
FIG. 3B is a schematic diagram illustrating a side view of the guide panel folded over the stop panel with an extension panel extending therefrom.
Figure 3C:
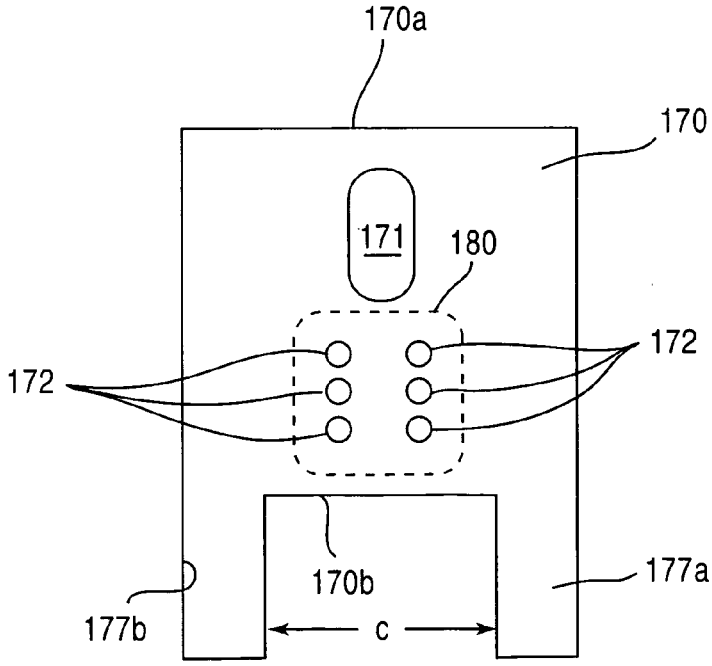
FIG. 3C is a plan view of a second embodiment of a stop panel having two extension panels extending therefrom.

While the stop panel 70, disclosed in co-pending application Ser. No. 10/226,312, increases the thickness of the package 1 a distance (y) from a first edge 30*a* of the second panel 30 to a second edge 70*b* of the stop panel 70 (see FIG. 3A), the extension panel 77 of the present invention increases the thickness and strength of the package 1 a distance (x) from the second edge 70*b* of the stop panel 70 to the second edge 30*b* of the second panel 30 (see FIG. 3B). Accordingly, the package 1 is difficult to tear along the side having the extension panel 77. Furthermore, as shown in FIG. 3C, in another embodiment of the stop panel 170, it is within the scope of the invention to provide first and second extension panels 177*a* and 177*b* extending away from the second edge 170*b* of the stop panel 170 at a location closest to the side of the second panel 30 proximate the score line 40. It is envisioned that such a second extension panel 177*b* would extend substantially parallel to, and as far as, the first extension panel 177*a*.

Furthermore, it is important to note that the stop panel 70, 170 and extension panel 77, 177*a*, 177*b* are sized to have an overall combined surface area that is smaller than an overall surface area of the second panel 30 such that second edge 70*b*, 170*b* of the stop panel 70, 170 is separated from a second edge 30*b* of the second panel 30 by a distance L (See FIG. 2) as the second edge 70*b*, 170*b* of the stop panel 70, 170, as well as the extension panel 77, 177*a*, 177*b*, is a portion of a stopper and alignment feature of the package 1.

The stop panel 70, 170 also includes a gripping aperture 71, 171 that is configured to coincide with and overlap the gripping apertures 21 and 31 of the first and second panels 20 and 30, respectively, as well as to coincide with and overlap the gripping aperture 51 of the first flap 50 of the first panel 20.

Referring to FIG. 3, for illustrative purposes only, to form the guiding channel C shown, an adhesive is applied to a first surface 70A of the stop panel 70 and a first surface 77A of the extension panel 77. Then, the stop panel 70 and extension panel 77 are folded over the fold line 43 to define the guiding channel C (FIG. 3) as well as the distance L (FIG. 2) between the second edge 70*b* of the stop panel 70 and the second edge 30*b* of the second panel 30. An adhesive is then applied to a first surface 38*a* of the guide panel 38, which is folded over score line 39 onto a second surface 70B (See FIG. 2) of the stop panel 70, as shown in FIG. 3. The guiding channel C, through which the inner slide card 100 is guided, is defined by the edge 38*e* of the guide panel 38 and the score line 40 separating the first and second panels 20 and 30, respectively. See FIG. 3.

A blister package (not shown) is then affixed to a region 80 on the stop panel 70. As noted above, the blister package is well known in the art and includes a backing that includes a foil portion (fp) through which each article held in a corresponding blister pocket must pass when being removed from the package 1. It should be noted that the blister pocket receiving apertures 32 and 72 of the second stop panels 30 and 70, respectively, are shown merely for illustration and that, in actuality, the apertures 32 and 72 would not be visible until the foil portion (fp) was ruptured upon removing an article from a corresponding blister pocket.

Figure 4:
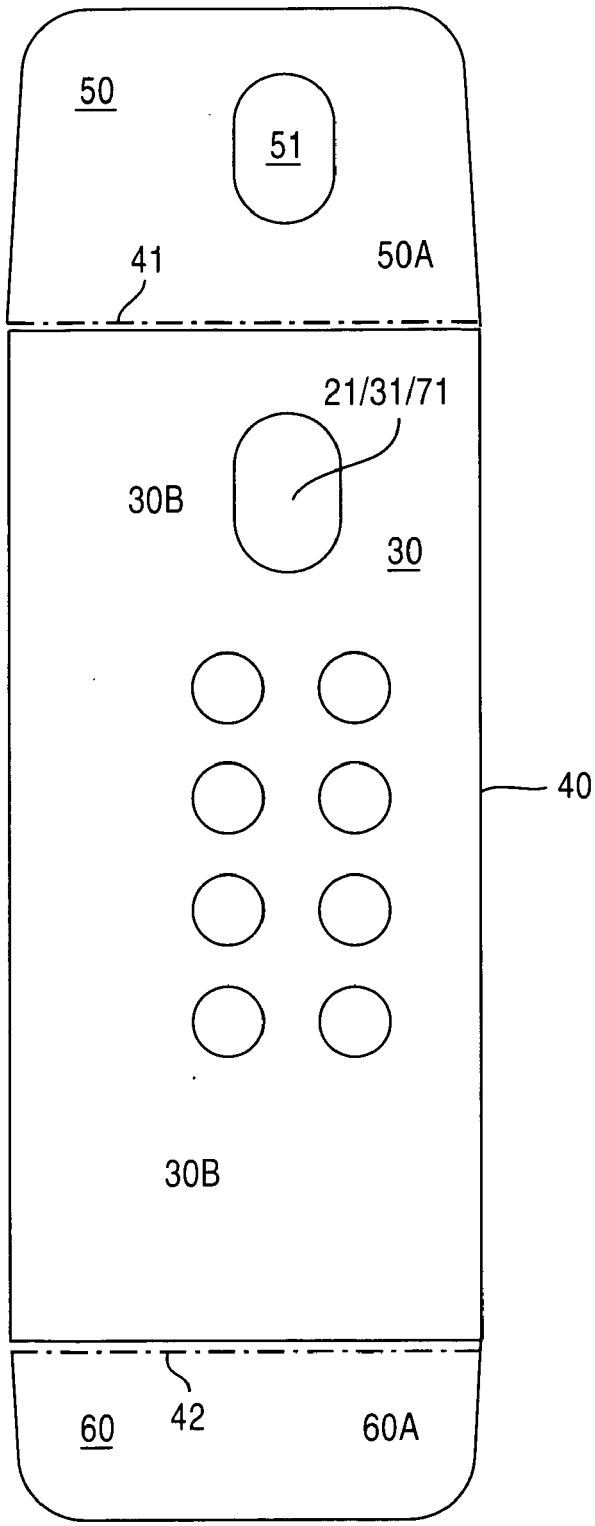
FIG. 4 is a top view of the second panel folded onto the first panel.

An adhesive is applied anywhere within adhesive regions 50A and 60A of the first and second flaps of the first panel 20. See FIG. 4. Furthermore, an adhesive is applied to a second surface 38B (See FIG. 3) of the guide panel 38. The second panel 30 is then folded over the score line 40 and adhered to the first panel 20, as shown in FIG. 4. The first and second flaps 50 and 60, respectively, are folded over score lines 41 and 42, respectively, and adhered to a second surface 30B of the second panel 30 to form the outer sleeve 10 of the package 1. See FIG. 5.

Figure 6:
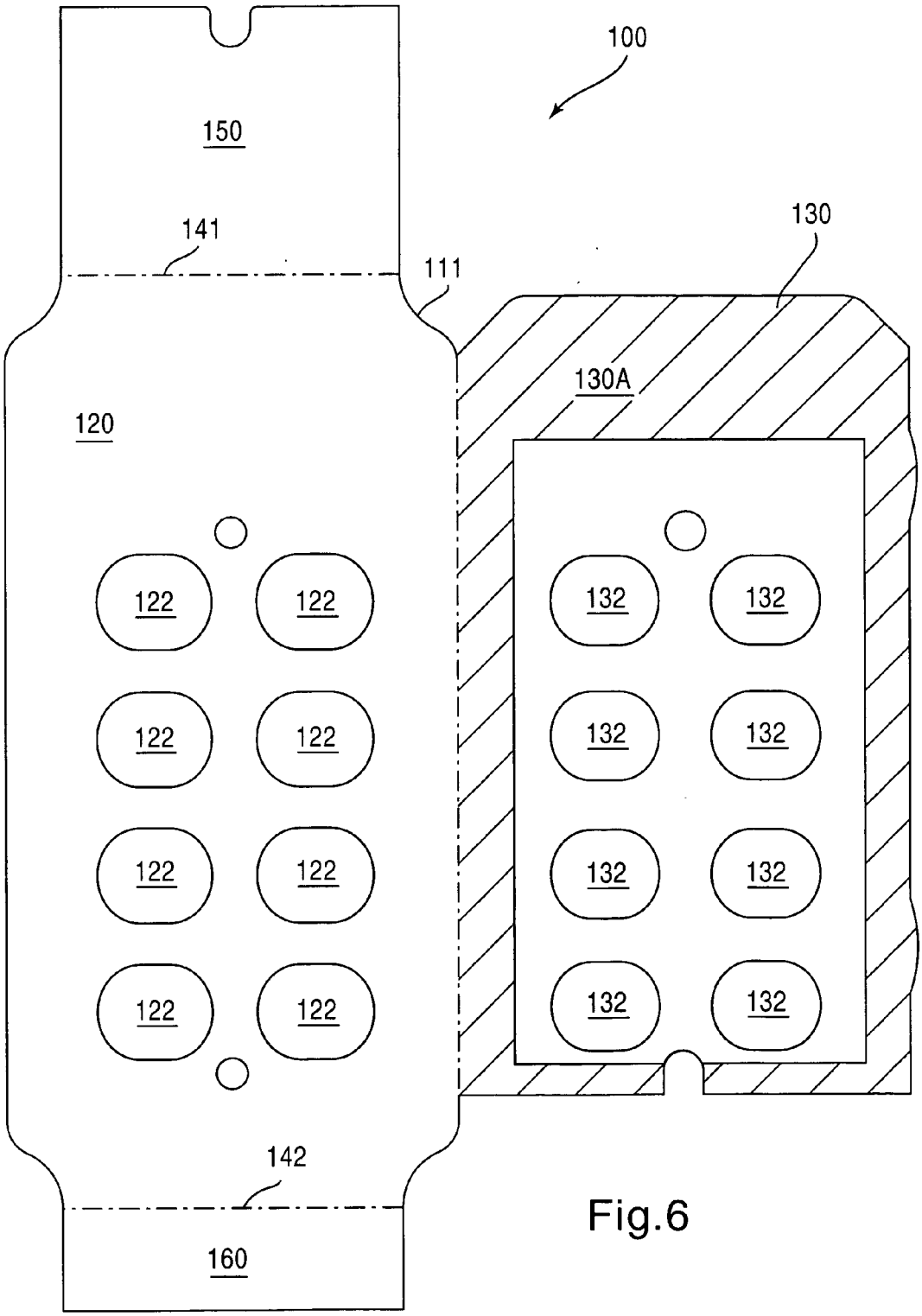
FIG. 6 is a top view of a disassembled slide card.

Referring to FIG. 6, the inner slide card 100 of the package 1 is formed from a flat, substantially rectangular-shaped single blank 111, ideally made from paperboard. However, it is within the scope of this invention to use any suitable material well known or later developed in the art, such as, for example, paper, plastic, metal, natural or man-made, and the like. Furthermore, although not illustrated but well understood in the art, it is within the scope of this invention to use any suitable geometric shape, such as, for example, square, trapezoidal, circular, oval, and the like to form the inner slide card 100.

The slide card 100 includes a first slide panel 120 separated from a second slide panel 130 by a score line 140. The score line 140 enables the second slide panel 130 to be folded over the first slide panel 120 as will be explained in further detail below. Score line 141 delimits a first flap 150 of the first slide panel 120 while score line 142 delimits a second flap 160 of the first slide panel 120. Score lines 141 and 142 enable the first and second flaps 150 and 160, respectively, to be folded over the second slide panel 130 as will be explained in further detail below.

The first slide panel 120 includes a plurality of aligning apertures 122 sized and configured to permit passage of the articles contained in the blister package from passing therethrough. Although the aligning apertures 122 are illustrated as being oval in shape, it should be noted that it is within the scope of this invention for the apertures to be any geometric shape that will facilitate passage of the articles therethrough. For example only, although not illustrated but well known in the art, the apertures can be circular, oblong, rectangular, square, trapezoidal, triangular, and the like. Furthermore, the number of aligning apertures 122, as well as their location, is selected to coincide with the number and location of corresponding exit apertures 22 in the first panel 20 and the blister pocket receiving apertures 32 in the second panel 30 of the outer sleeve 10.

Likewise, the second slide panel 130 includes a plurality of aligning apertures 132 sized and configured to permit passage of the articles contained in the blister package from passing therethrough. Although the aligning apertures 132 are illustrated as being oval in shape, it should be noted that it is within the scope of this invention for the apertures to be any geometric shape that will facilitate passage of the articles therethrough. For example only, although not illustrated but well known in the art, the apertures can be circular, oblong, rectangular, square, trapezoidal, triangular, and the like. Furthermore, the number of aligning apertures 132, as well as their location, is selected so as to coincide with the number and location of the exit apertures 22 in the first panel 20 of the outer sleeve 10, the blister pocket receiving apertures 32 in the second panel 30 of the outer sleeve 10, and the aligning apertures 122 in the first slide panel 120 of the slide card 100.

In other words, when the package 1 is fully assembled and the apertures 122 and 132 of the slide card 100 are positioned to permit a user to remove an article from the package 1, the blister pocket receiving apertures 32 of the second panel 30 of the outer sleeve will coincide with and overlap the aligning apertures 132 of the second slide panel 130 of the slide card 100. The aligning apertures 132 of the second slide panel 130 will coincide with and overlap the aligning apertures 122 of the first slide panel 120 of the slide card 100. Finally, the aligning apertures 122 of the first slide panel 120 coincide with and overlap the exit apertures 22 of the first panel of the outer sleeve 10.

It should be noted that the geometric configuration of the exit apertures 22 and blister pocket receiving apertures 32 are shown as circular merely for illustrative purposes. Likewise, the geometric configuration of the aligning apertures 122 and 132 are shown as oval merely for illustrative purposes. It is within the scope of this invention to have the exit apertures 22, blister pocket receiving apertures 32, and aligning apertures 122 and 132 each be of the same geometric configuration or each may be a different geometric configuration so long as the articles contained in the blister package can pass therethrough.

FIG. 6 illustrates an exemplary embodiment where an adhesive region 130A is provided around an outer periphery of the second slide panel 130. However, it should be noted that the adhesive region 130A is not limited to the periphery of the second slide panel 130 but can include the entire surface area of the second slide panel 130 that does not correspond to the exit apertures 132 defined therein. In other words, the adhesive can be applied anywhere on the second slide panel 130 so long as the exit apertures 132 are not covered or blocked by the adhesive.

Figure 7:
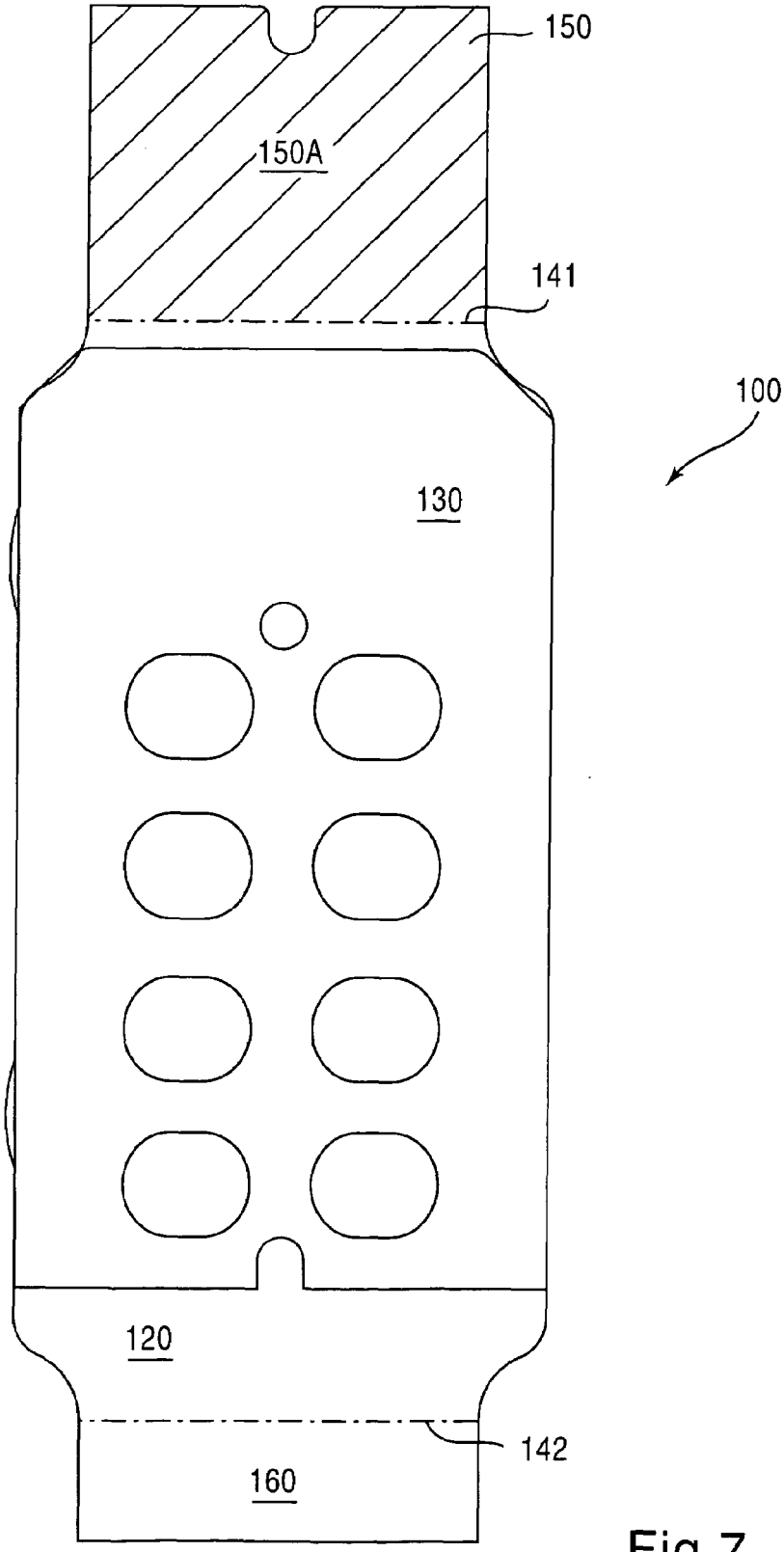
FIG. 7 is a top view of the slide card with the second slide panel folded over and adhered onto the first slide panel of the slide card shown in FIG. 6.

The second slide panel 130 is then folded over the score line 140 and adhered to the first slide panel 120, as shown in FIG. 7, to form the slide card 100 of the package 1. FIG. 7 clearly shows the aligning apertures 122 and 132 of the first and second slide panels 120 and 130, respectively, coinciding with and overlapping each other.

Figure 8:
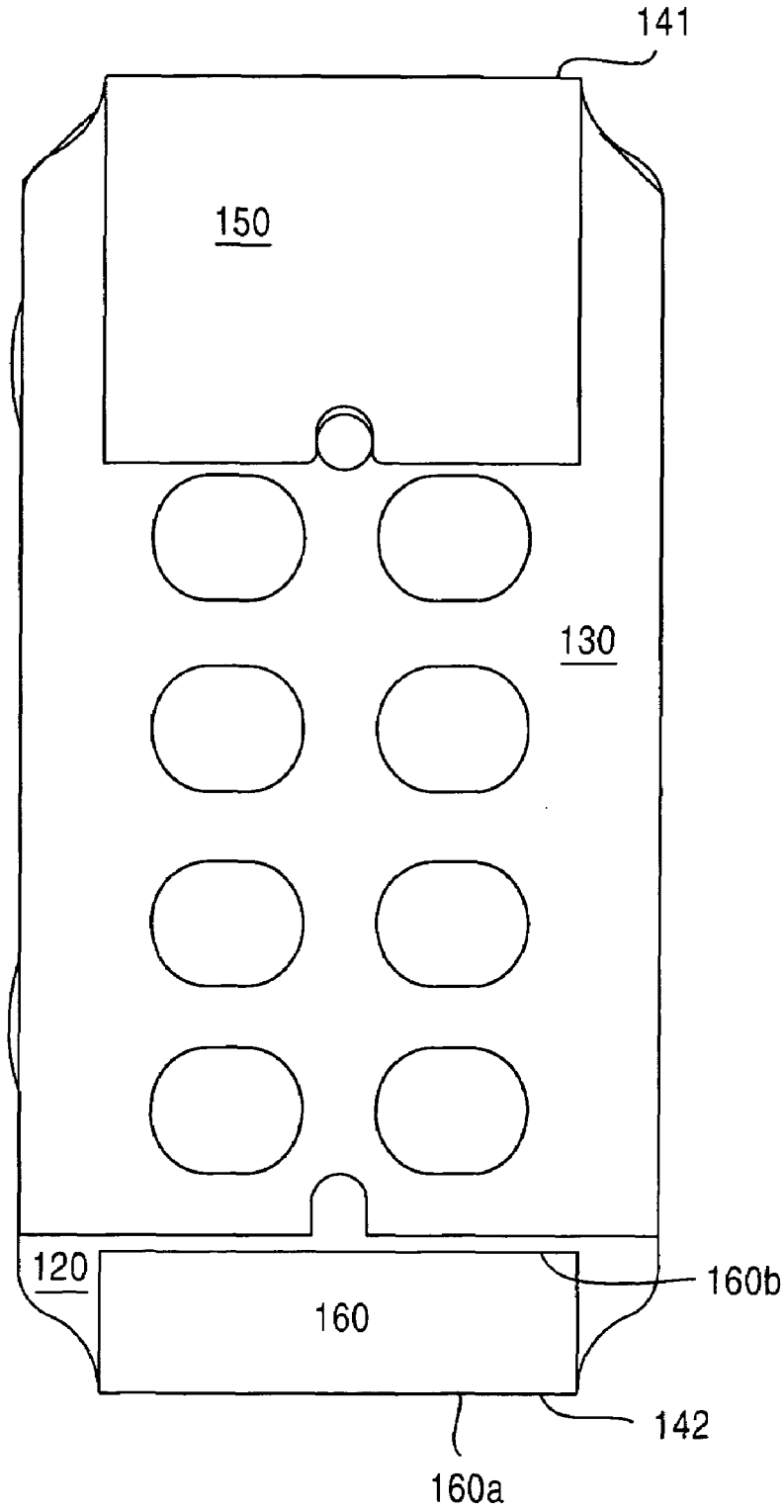
FIG. 8 is a top view of the slide card with first and second flaps of the first slide panel folded over onto the second slide panel to form an assembled slide card.

An adhesive is applied anywhere within adhesive region 150A of the first flap 150 of the first slide panel 120 of the slide card 100. Furthermore, it should be noted that adhesive is not provided on the second flap 160 of the first slide panel 120 for reasons that will be discussed in further detail below. As shown in FIG. 8, the first flap 150 of the first slide panel 120 is folded over score line 141 and adhered to the second slide panel 130, which is adhered to the first slide panel 120. Similarly, the second flap 160 of the first slide panel 120 is folded over score line 142, but not adhered to the second slide panel 130, to form a completely assembled slide card 100.

The second flap 160 of the first slide panel 120 has a first edge 160*a* that coincides with score line 142. Opposite and substantially parallel to the first edge 160*a* and score line 142 is a second edge 160*b* of the second flap 160. Since the second flap 160 is not adhered to the first slide panel 120, the second edge 160*b* remains slightly elevated from the surface of the first slide panel 120. As will be clear from the discussion below, the second edge 160*b* of the second flap 160 forms a portion of the stopper and alignment feature of the package 1.

Figure 5:
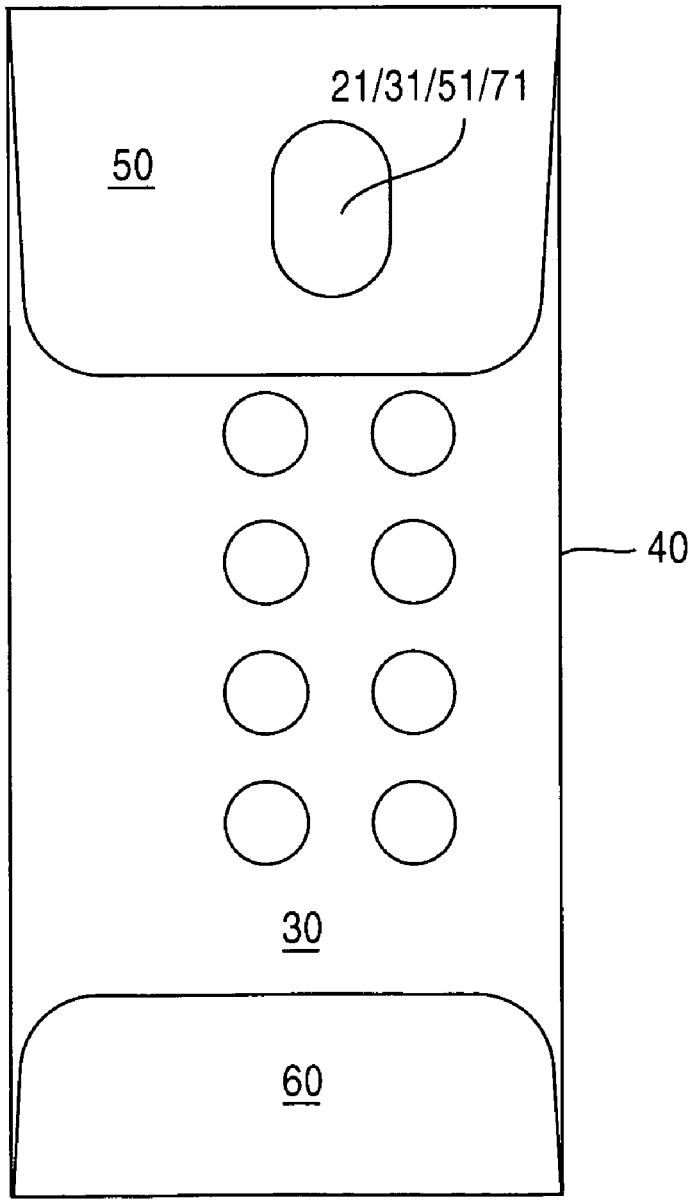
FIG. 5 is a top view of first and second flaps of the first panel folded onto the second panel to form an assembled outer sleeve of the package.
Figure 9:
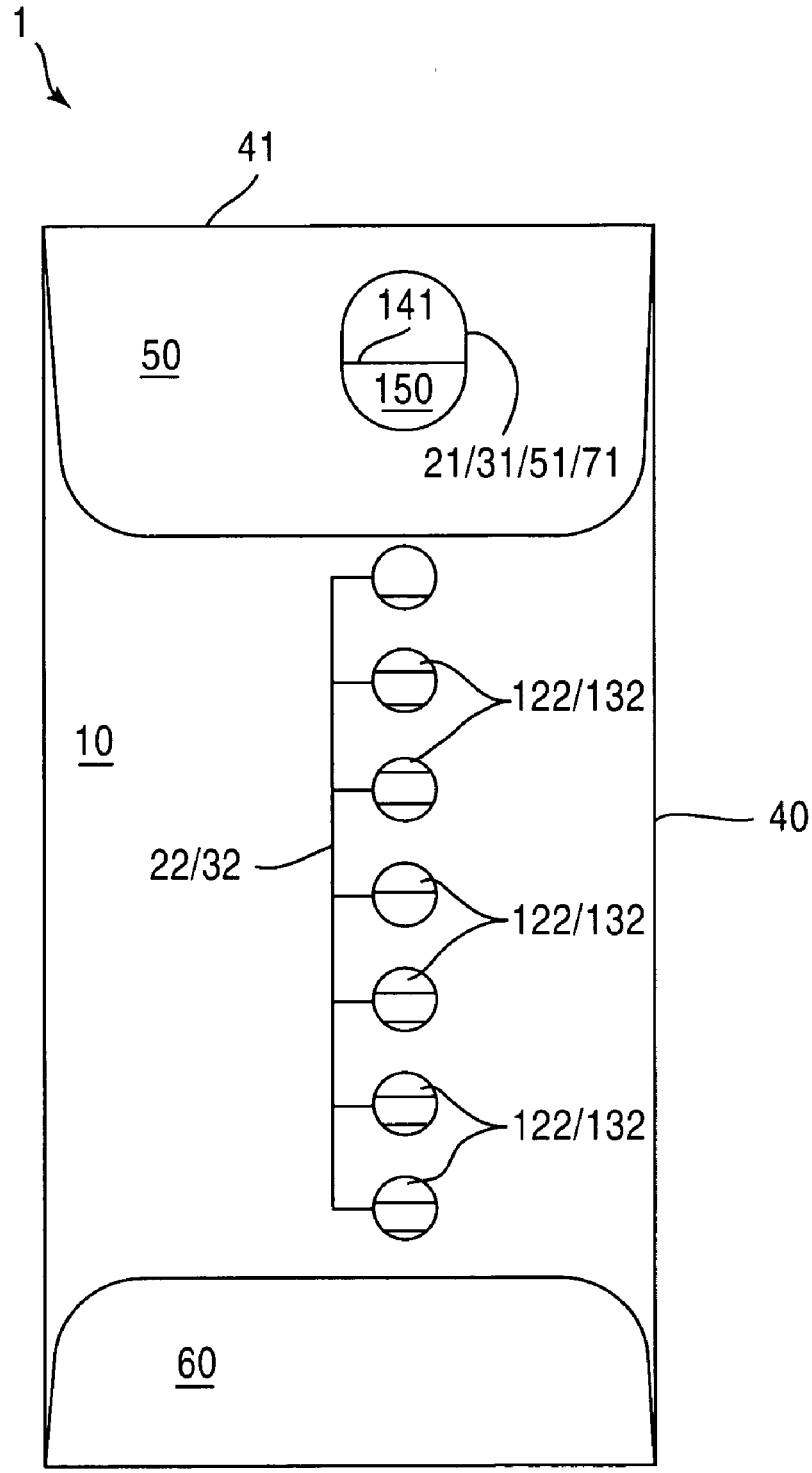
FIG. 9 is a perspective view of the assembled package with the slide card of FIG. 8 inserted into the outer sleeve of FIG. 3.

As shown in FIG. 9, the slide card 100 is inserted within the outer sleeve shown in FIG. 5 and the first and second flaps 50 and 60 of the outer sleeve are folded over respective score lines 41 and 42 to complete assembly of the package 1. The operational state of the package 1 shown in FIG. 9 is where the exit and blister pocket receiving apertures 22 and 32 of the first and second panels 50 and 60 of the outer sleeve 10 are not aligned with the aligning apertures 122 and 132 of the first and second slide panels 120 and 130 of the slide card 100. The aligning apertures 122 and 132 are, at a minimum, partially blocking the exit and blister pocket receiving apertures 22 and 32 so that articles contained in the blister package cannot pass therethrough, which prevents the articles from being removed from the assembled package 1.

Figure 10:
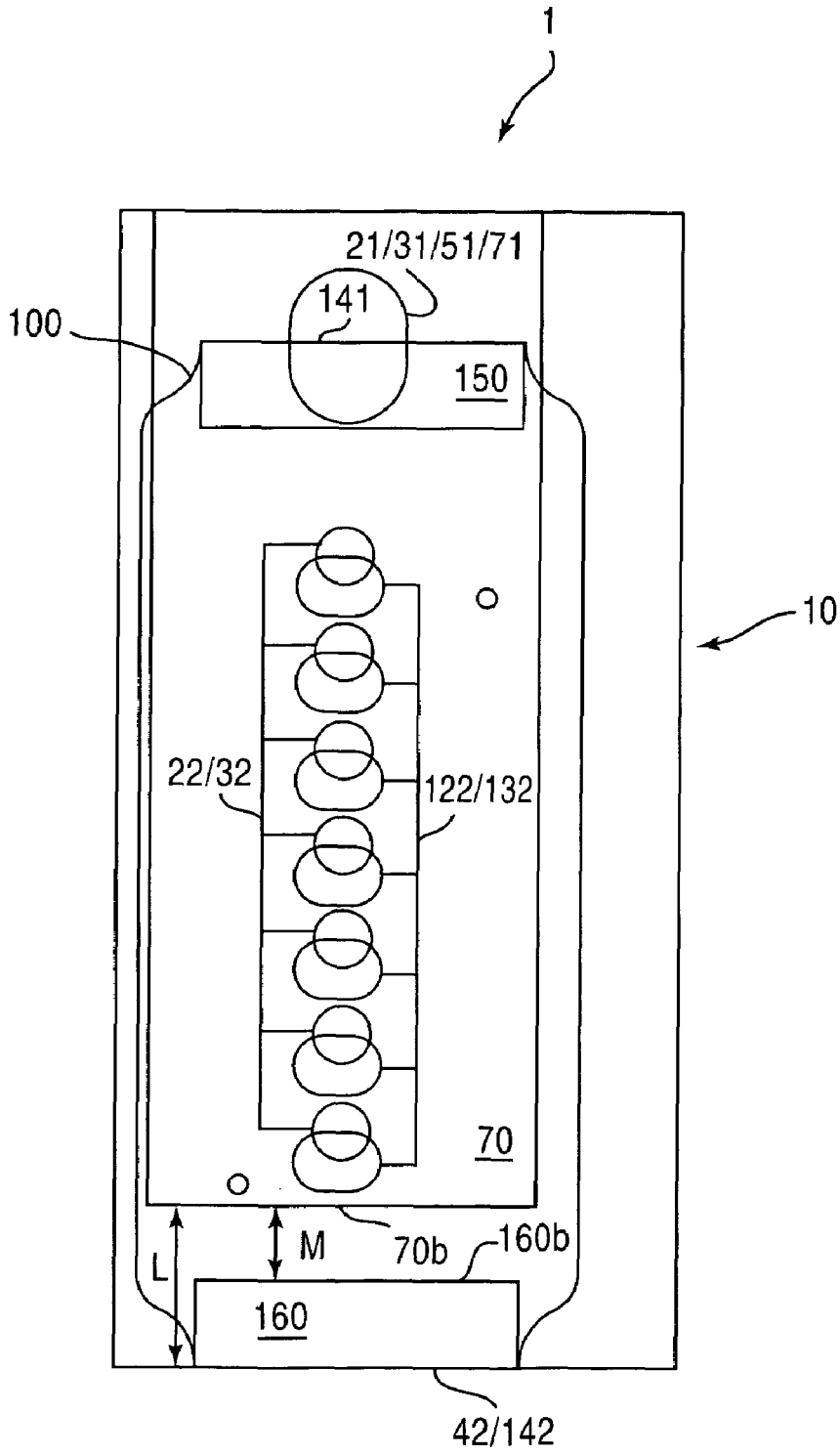
FIG. 10 is a perspective view of the assembled package according to the preferred embodiment of the invention with the slide card inserted in the outer sleeve and the slide card blocking the articles contained in the package from being removed.

FIG. 10 shows a schematic diagram of the arrangement illustrated in FIG. 9. In particular, it can be seen that when the score line 142 of the slide card 100 abuts the score line 42 of the outer sleeve, the first flap 150 of the slide card 100 does not substantially occupy the gripping aperture 21, 31, 51, and 71 of the outer sleeve 10. Additionally, the channel C, through which the slide card 100 travels, is defined by the edge 38*e* of the guide panel 38 overlapping the extension panel 77 and score line 40.

Furthermore, a sliding distance M between the second edge 70*b* of the stop panel 70 and the second edge 160*b* of the second flap 160 of the slide card 100 is less than L but greater than or equal to zero. That is, the sliding distance M is defined by the relationship $L>M\geqq 0$. Additionally, the partial blockage of the exit and blister pocket receiving apertures by the aligning apertures 122 and 132 is more clearly illustrated.

Figure 11:
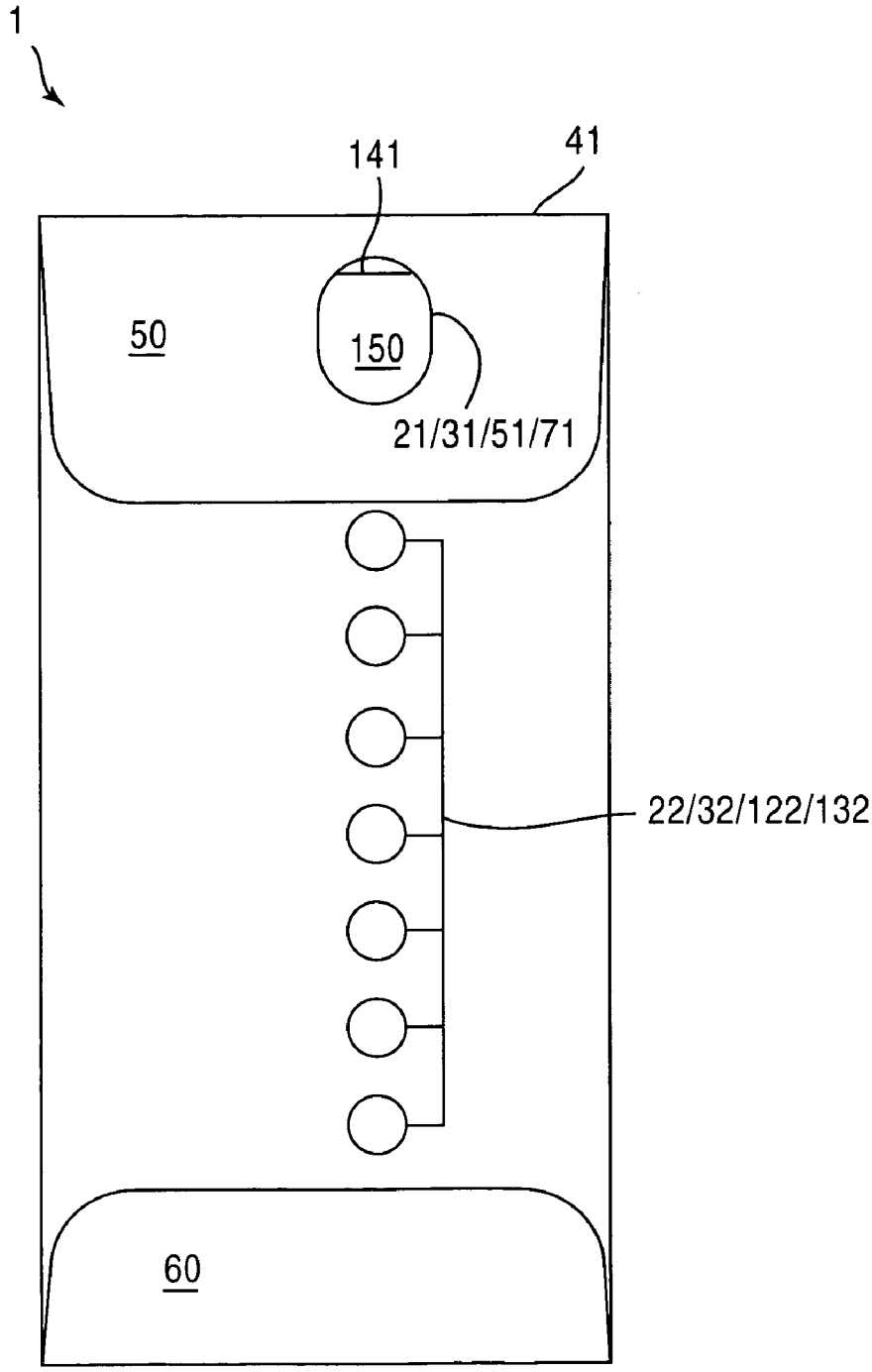
FIG. 11 is a perspective view of the assembled package according to the preferred embodiment of the invention with the slide card inserted in the outer sleeve and the slide card positioned so the articles contained in the package can be removed.

As shown in FIG. 11, the operational state of the package 1 illustrated is the slide card 100 being slid through the channel C defined within the outer sleeve 10 by a user grabbing the first flap 150 of the slide card 100 and sliding the slide card 100 upwards as viewed in the drawing such that the gripping aperture 21, 31, 51, and 71 is substantially blocked by the first flap 150. Furthermore, the aligning apertures 122 and 132 are not visible as they are substantially aligned with the exit and blister pocket receiving apertures 22 and 32 such that an article (not shown) contained in a blister pocket (not shown) may pass therethrough.

Figure 12:
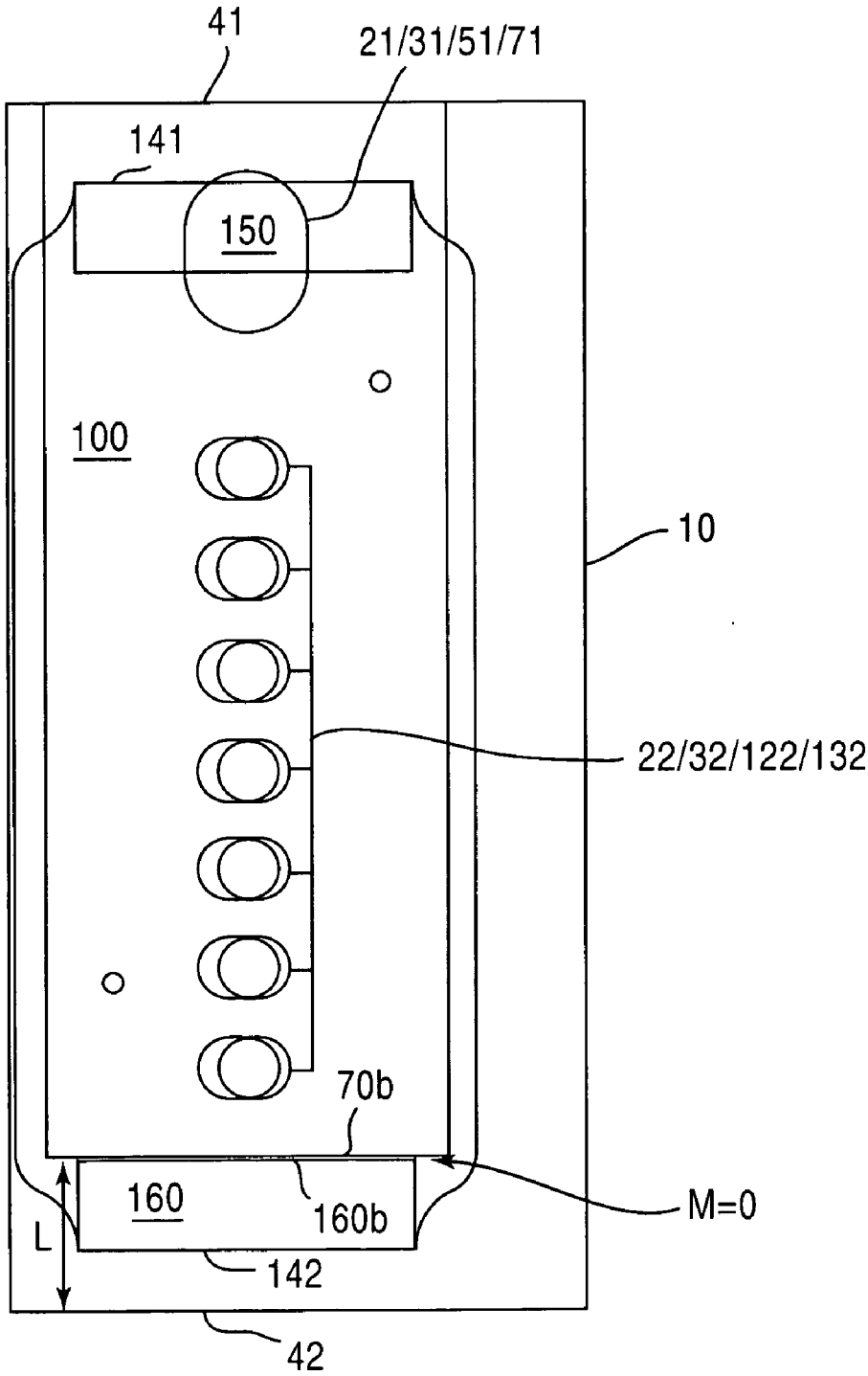
FIG. 12 is a schematic diagram of the arrangement shown in FIG. 11
Figure 13:
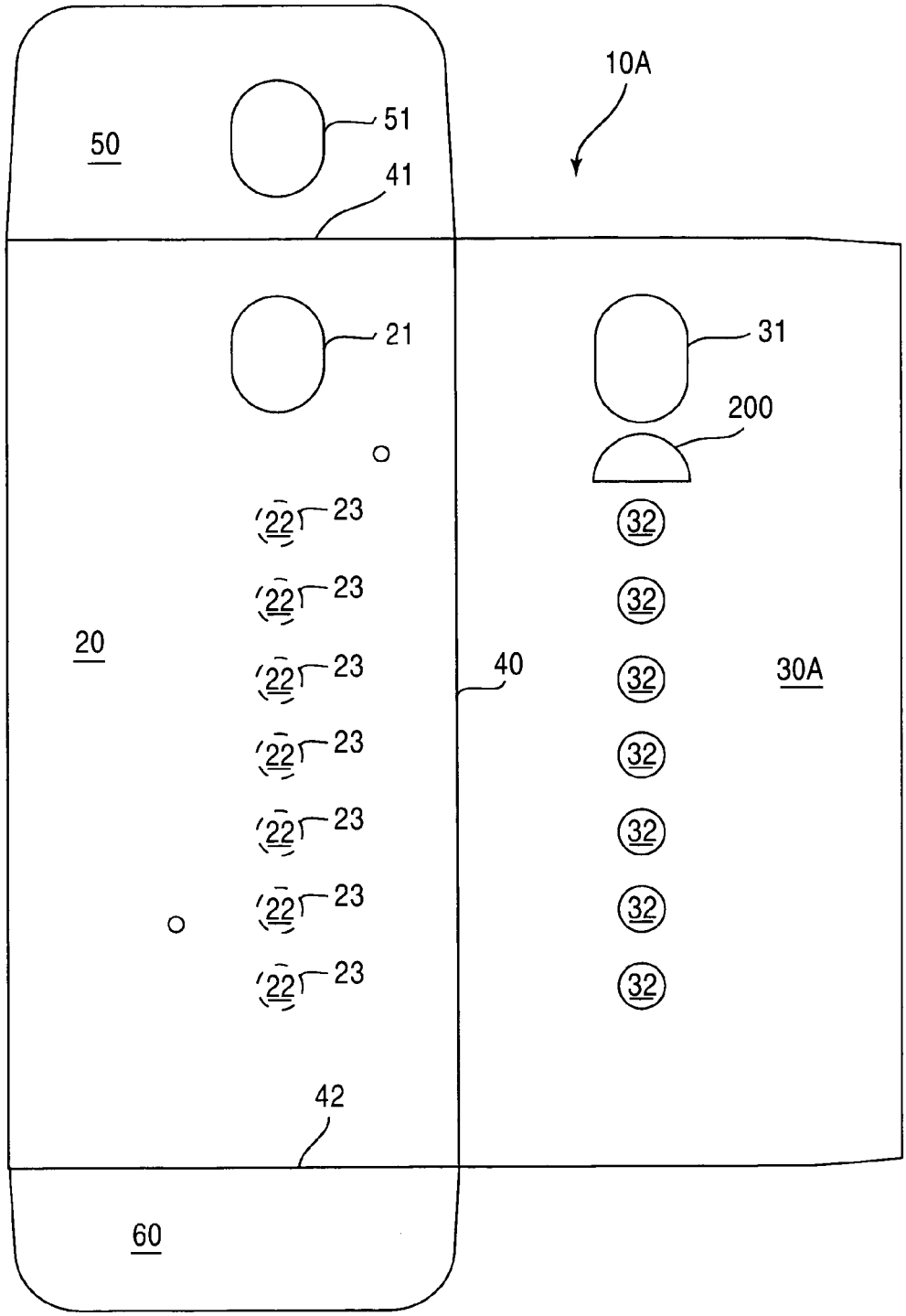
FIG. 13 is a top view of an outer sleeve of the disassembled package according to another embodiment of the invention.

FIG. 12 shows a schematic diagram of the arrangement shown in FIG. 10. Specifically, as the slide card 100 is held by a user via the gripping aperture 21, 31, 51, and 71 and slid upward through the channel C as viewed in the drawing, the sliding distance M approaches zero. That is, the sliding distance M is defined as $M\geqq 0$. When $M=0$, the second edge 70*b* of the stop panel 70 abuts the raised second edge 160*b* of the second flap 160 of the slide card 100. The second edge 70*b* of the stop panel 70 prevents the slide card 100 from any further sliding movement. In other words, the second edge 70*b* of the stop panel 70 prevents the slide card 100 from moving any further in an upward direction when viewing the drawing. Likewise, the edge 38*e* of the guide panel 38 prevents the slide card 100 from wobbling, moving laterally, or in a sideway direction when viewing the drawing. Simultaneously with the stoppage of the slide card 100 from moving any further, the exit and blister pocket receiving apertures 22 and 32, respectively, are aligned with the aligning apertures 122 and 132 of the slide card 100.

The above described structural configuration of the package 1 provides a package that is easy to use by adults yet prevents unwanted access to the articles therein by children. In particular, the simultaneous stop and alignment feature of the package 1 requires an individual to recognize that the only way to have access to the articles contained therein is to slide the slide card 100 until a raised stop feature 160*b* thereon engages a stop feature 70*b* in the outer sleeve 10, which simultaneously prevents further sliding motion of the slide card 100 therein but also aligns the relevant apertures 22, 32, 122, and 132 so that the desired articles may pass therethrough. Furthermore, the extension panel 77 extends the length (y) of the stop panel 70 that adds to the thickness of the overall package along the side of the outer sleeve 10 and is overlapped by the guide panel 38 by an additional length (x), as shown in FIG. 2. The additional thickness and resulting strength of the outer sleeve greatly enhances the tamper-resistant nature of the package 1 and renders the articles contained within the package less accessible to children.

Another embodiment of the invention will now be described with reference to drawing FIGS. 13–18, wherein common reference characters are used to identify common features.

A difference between the below-described embodiment and the above-described preferred embodiment is the provision of a lock aperture 200 in the second panel 30A. The lock aperture 200 provides a user access to a lock 250 provided on the first flap 150 of the slide card 100A, which is described in further detail below. The lock aperture 200 is illustrated as being hemispherical in FIG. 13, but it should be understood that it is within the scope of this invention to have the lock aperture 200 be any suitable geometric configuration that will permit a user access to the lock 250 therein. For example only, although not shown but well understood in the art, the lock aperture 200 can be circular, oval, oblong, square, rectangular, trapezoidal, triangular, and the like.

Figure 14:
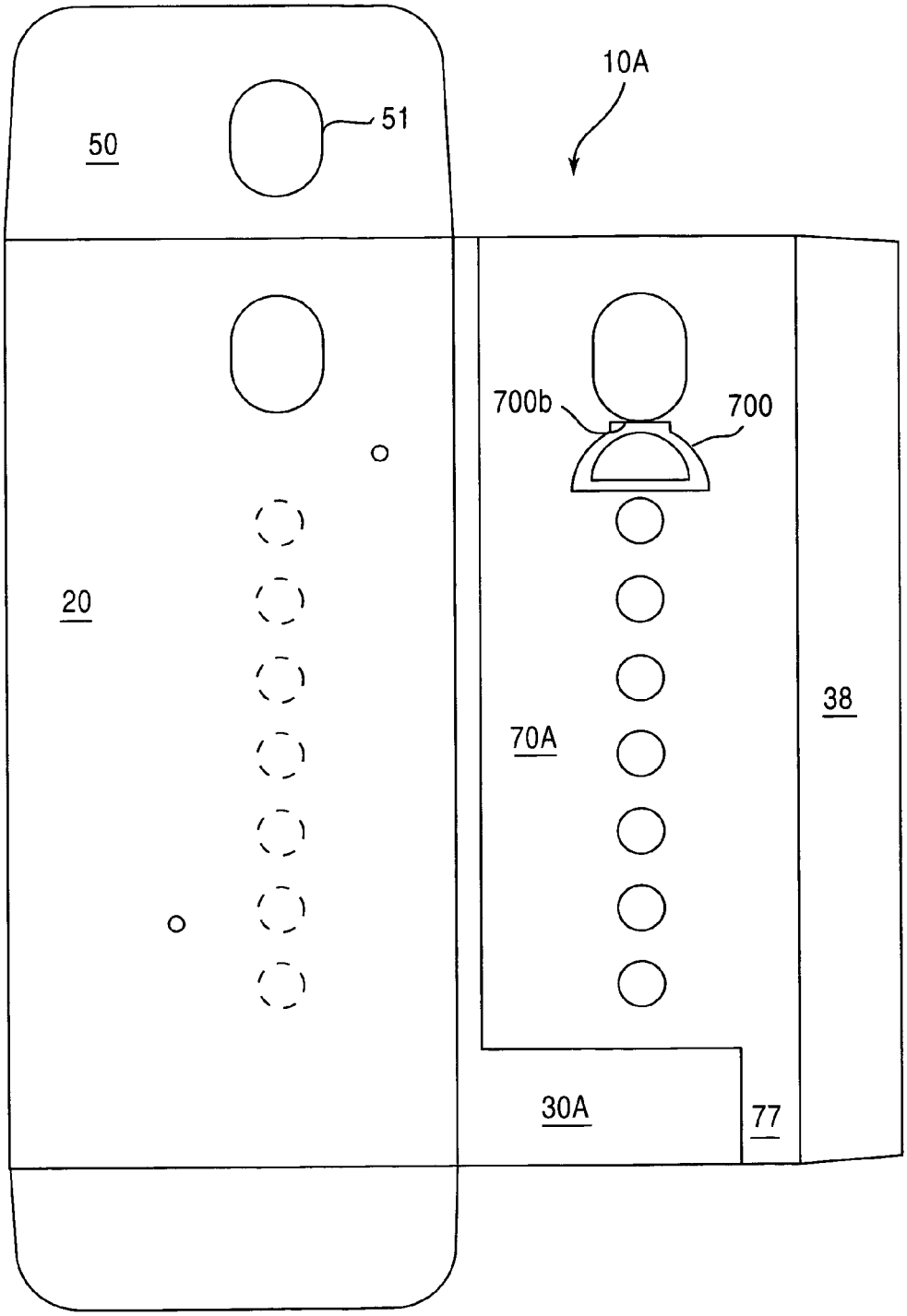
FIG. 14 is a top view of the outer sleeve of FIG. 13 with a third embodiment of the stop panel.

FIG. 14 illustrates a third embodiment of the stop panel 70A having a lock stop 700 that is configured to encompass the lock aperture 200 on the second panel 30A of the outer sleeve 10A. The geometric configuration of the lock stop 700 should be chosen so that the lock stop 700 encompasses the lock aperture 200 and is able to engage the lock 250 on the first flap 150 of the slide card 100A so that the slide card cannot be slid within the outer sleeve 100A until the lock 250 is depressed, as will be explained in further detail below. The lock stop 700 includes a stop edge 700*b* that engages a second lock edge 250*b* on the lock 250 that prevents the slide card 100A from sliding until the lock 250 is depressed by a user through the lock aperture 200.

Figure 15:
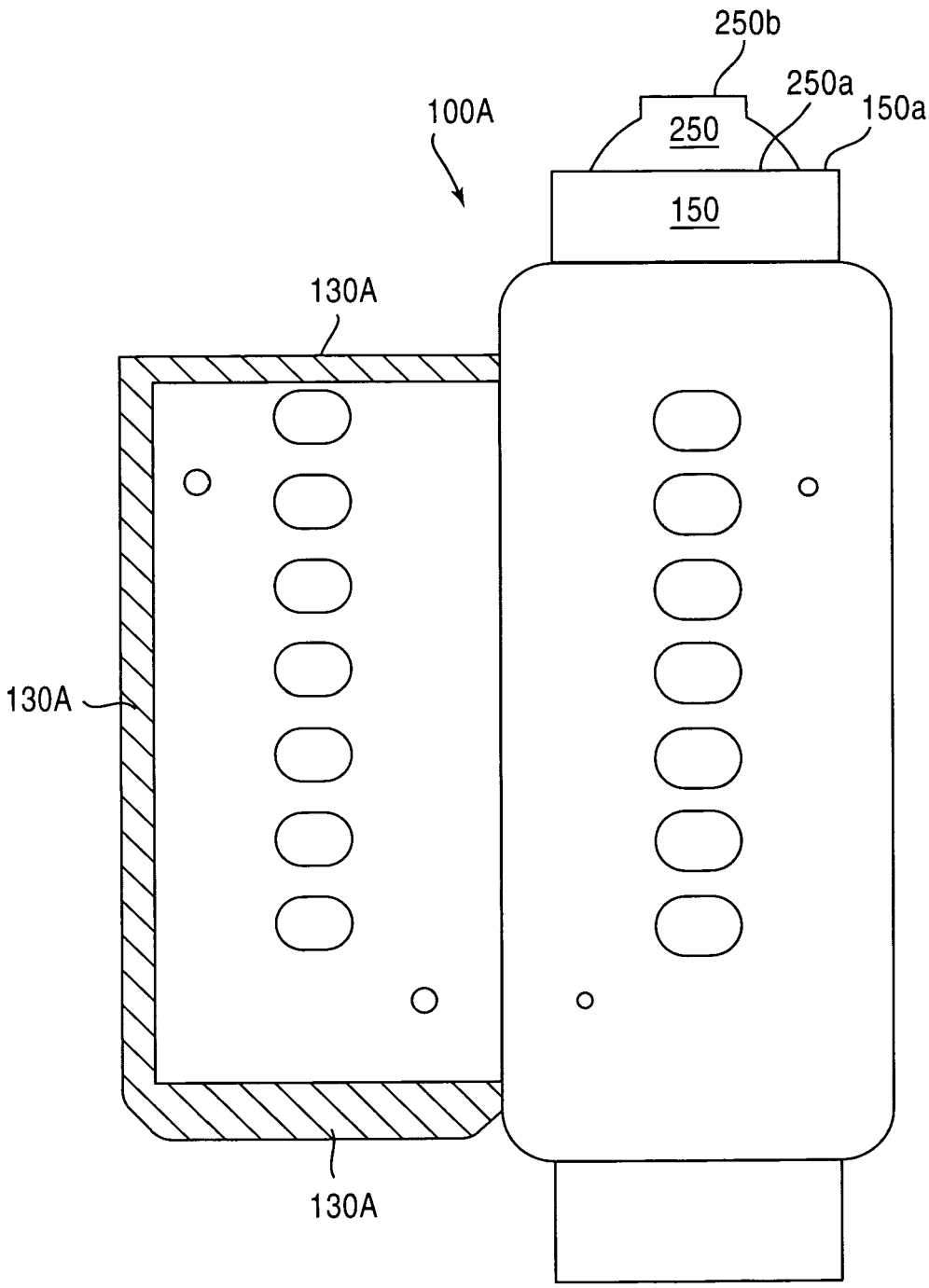
FIG. 15 is a top view of a slide card of the disassembled package according to another embodiment of the invention.

In particular, as shown in FIG. 15, another embodiment of the slide card 100A has the lock 250 attached to an edge 150*a* of the first flap 150 at a first lock edge 250*a*. The geometric configuration of the lock 250 corresponds to the geometric configuration of the lock stop 700. It should be noted that the geometric configurations of the lock stop 700 and lock 250 shown in FIGS. 14–18 are merely illustrative and in no way intended to limit the scope of this invention. The geometric shape of the lock stop 700 and lock 250, although not shown but easily understood by one of ordinary skill in the art, can be circular, arc-shaped, hemispherical, square, rectangular, triangular, trapezoidal, and the like.

Figure 16:
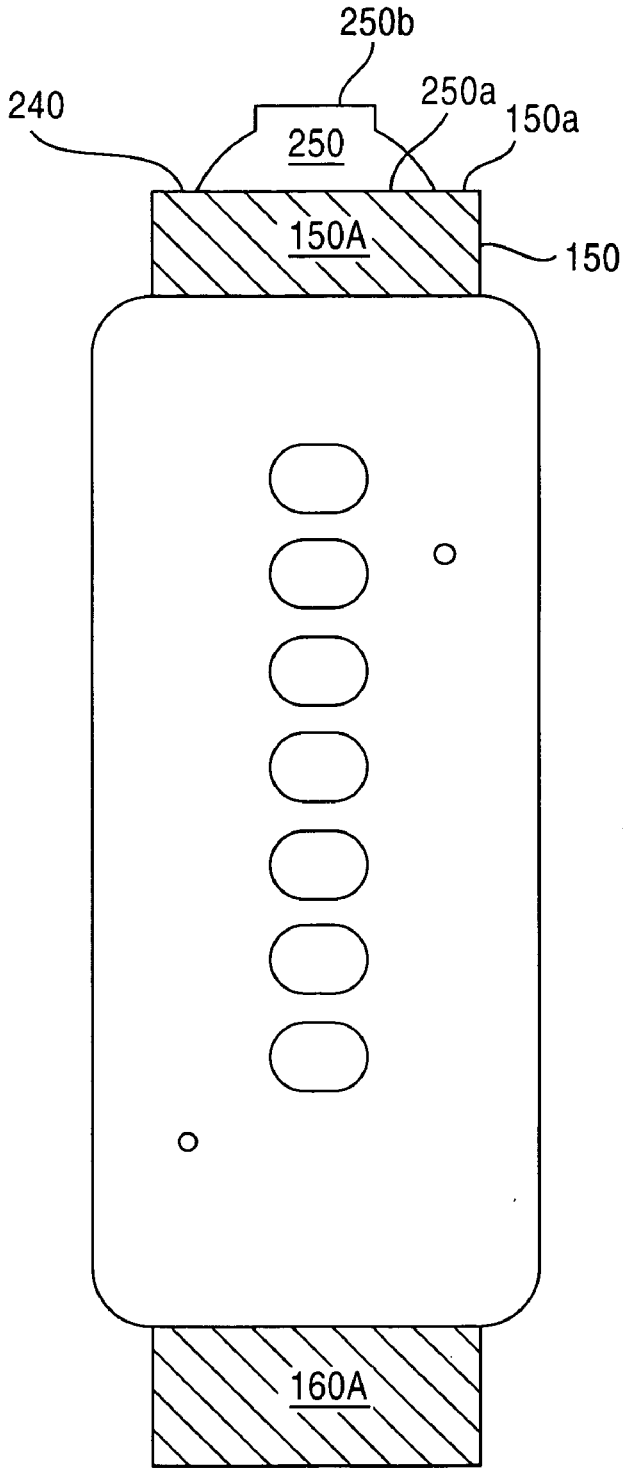
FIG. 16 is a top view of the slide card of FIG. 15 with the second slide panel adhered to the first panel.
Figure 17:
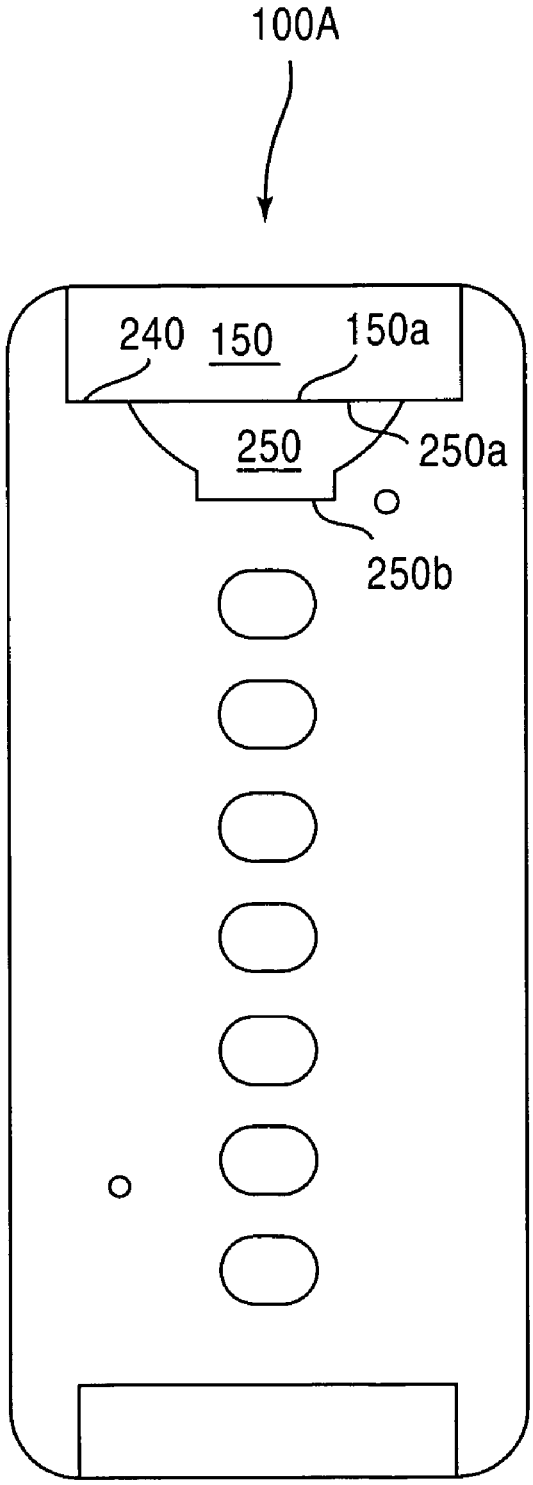
FIG. 17 is a top view of the slide card of FIG. 16 with the first and second flaps folded over the second slide panel of the slide card.
Figure 18:
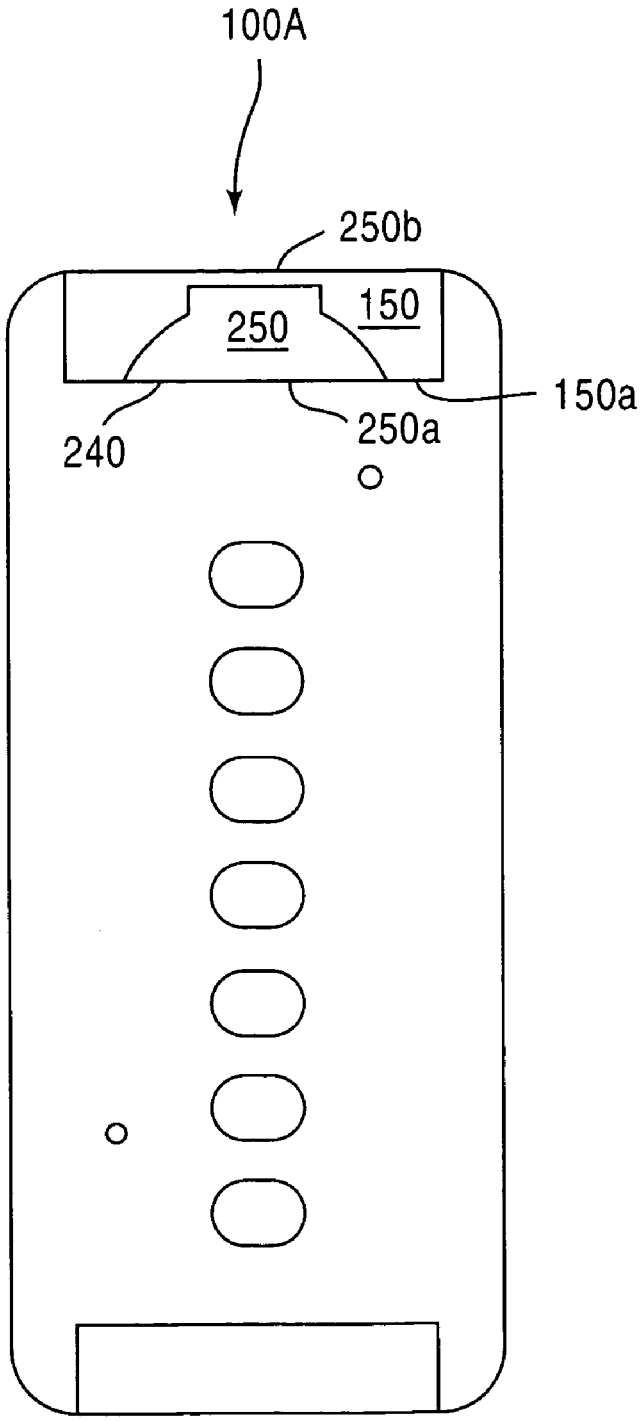
FIG. 18 is a top view of the slide card of FIG. 17 with the lock folded over the first panel of the slide card.

As shown in FIG. 16, a second lock edge 250*b* of the lock 250 is relatively parallel to, and remote from, the first lock edge 250*a*. The lock 250 is folded over a score line 240 that delimits the lock 250 from the first flap 150 of the slide card 100A. Therefore, after the first flap 150 has been adhered to the second slide panel 130, as shown in FIG. 17, the lock 250 is folded over the score line 240 as shown in FIG. 18 and can be biased to and from the first flap 150 when depressed and released by a user.

Accordingly, when the slide card 100A is inserted into the outer sleeve 101A, the lock 250 biases upward so that the second lock edge 250*b* engages the stop edge 700*b* of the lock stop 700. To unlock the lock 250, a user simply reaches through the lock aperture 200 in the second panel 30A of the outer sleeve 100A and depresses the lock 250, whereupon the second lock edge 250*b* is disengaged from the stop edge 700*b*.

A user then accesses the articles contained in the blister pockets by sliding the slide card 100A until the raised second edge 160*b* of the second flap 160 of the slide card engages the stop feature 70*b* of the stop panel 70A as described above for the preferred embodiment.

As such, the above-described embodiment of the invention provides a child resistant package that has an additional feature to restrict child-access to the articles contained therein. In particular, the embodiment provides a two step process for accessing the articles, which includes unlocking the slide card 100A contained in the package 1A before sliding the slide card 100A until the apertures 22, 32, 122, and 132 are aligned when the sliding movement is stopped by the engagement of the edges 160*b* and 70*b* of the second flap panel 160 and stop panel 70A, respectively.

Figure 19:
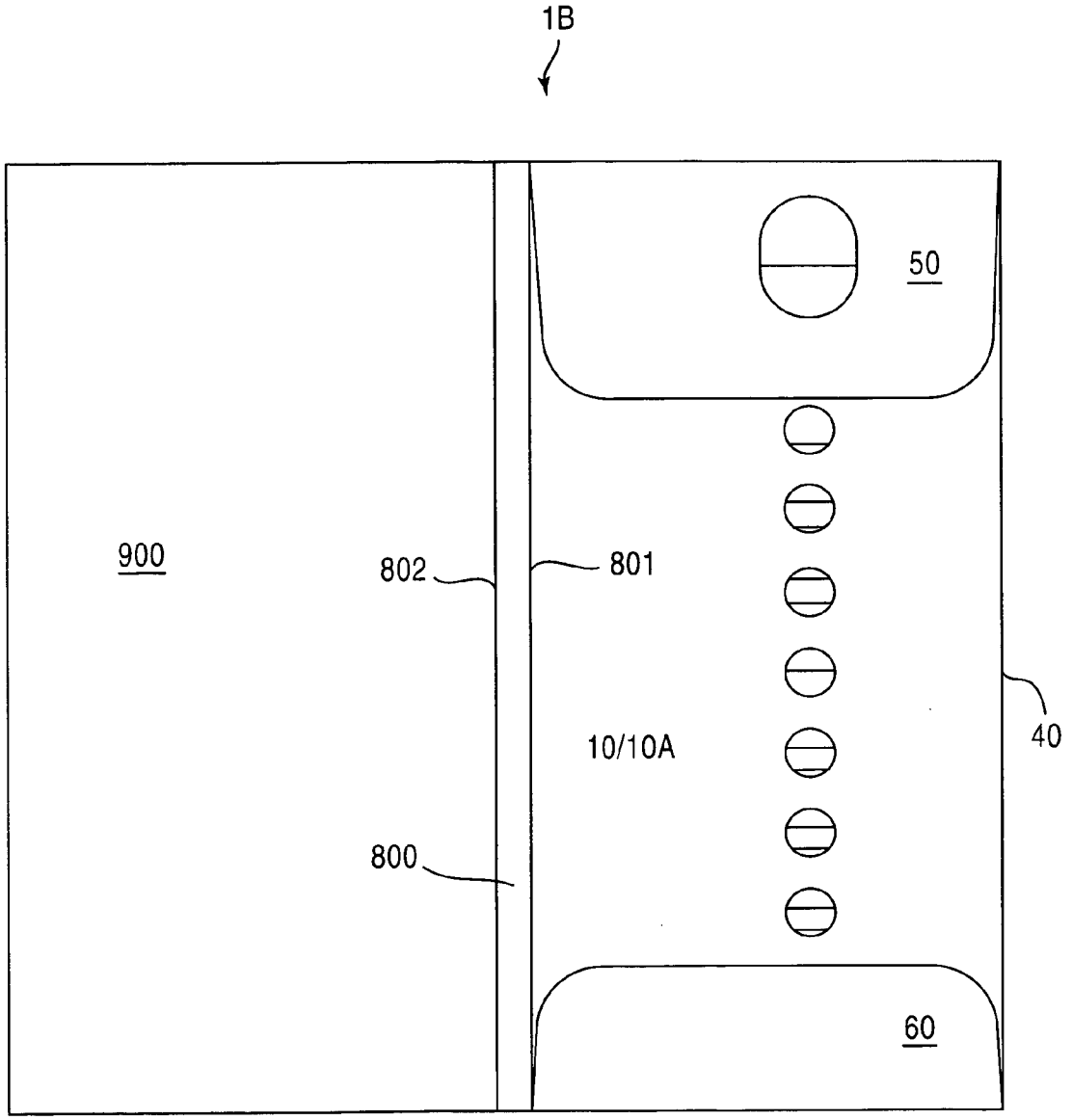
FIG. 19 is a top view of the assembled package according to yet another embodiment of the invention.

Yet another embodiment of the invention will now be described with reference to drawing FIG. 19, wherein common reference characters are used to identify common features.

The package 1B is substantially similar to the packages 1 and 1A of the above-described embodiments with regard to FIGS. 1–18. As such, a detailed discussion of the panels 20, 30, 120, and 130 is omitted. However, it should be noted that a hinge panel 800 is adjoined to the first panel 20 of the package 1B at a score line 801 that delimits the hinge panel 800 with another score line 802. As shown in FIG. 19, the hinge panel 800 is between the first panel 20 and a cover panel 900. The cover panel 900 is foldable over the score lines 801 and 802 that form the hinge panel 800.

As such, the package 1B can take the form of a book when the cover panel 900 is folded over the score lines 801 and 802 that delimit the hinge panel 800. It should be noted that the cover may include indicia, such as, for example only, the name of the article manufacturer, the dosage of the article, when the article should be taken, how the article should be taken, and other such information that would be considered useful to the user.

Many modifications may be made to adapt the teachings of the package of this invention to particular situations or materials without departing from the scope thereof. For example, the first and second flaps, respectively, of the first panel for the outer sleeve of any of the above-described three exemplary embodiments may be omitted and the peripheral portions of the first and second ends of the second panel be provided with adhesive to seal the first and second panels together, along with the adhesive on the second side of the guide panel. Therefore, this invention should not be limited to the particular embodiments disclosed herein, but includes all embodiments within the spirit and scope of the disclosure.

We claim:

1. A simultaneous stop, alignment, and enhanced tamper-resistant feature of a package having an outer sleeve containing blister packaging with at least one blister pocket receiving aperture that retains a corresponding at least one blister containing an article therein and at least one exit aperture corresponding to the at least one blister pocket receiving aperture, the package also having a slide card with at least one aligning aperture, the slide card being slidably disposed within the outer sleeve, the stop and alignment feature comprising:

a stop panel disposed on an inside surface of the outer sleeve, the stop panel having a first end and a second end opposite and substantially parallel to the first end;

a stop panel edge defined by a portion of the first end of the stop panel;

an extension panel connected to and extending away from a remaining portion of the first end of the stop panel;

a guide panel extending along a longitudinal edge of the outer sleeve and having a length equal to or greater than a combined length of the stop panel and extension panel, wherein the guide panel is folded over the extension panel; and a channel (C) defined by an edge of the extension panel and a score line separating first and second panels of the outer sleeve, wherein the slide card travels through the channel (C).

2. The feature according to claim 1, wherein the guide panel completely covers the extension panel and partially covers the stop panel.

3. The feature according to claim 1, wherein the extension panel is integral with the stop panel.

4. The feature according to claim 1, wherein the guide panel is integral with the outer sleeve.

5. The feature according to claim 1, wherein the stop panel edge is spaced a predetermined distance (L) from a first end of the outer sleeve, and the feature further comprises:

a first flap on an outside surface of the slide card having a raised flap edge at a first end of the slide card, wherein the raised flap edge may travel across a sliding distance (M) defined by the relationship $L>M\geqq 0$, and wherein when the raised flap edge engages the stop panel edge, the sliding distance is defined by the relationship $M=0$ and the slide card is prevented from further sliding within the outer sleeve, the at least one blister pocket receiving aperture and at least one exit aperture of the outer sleeve are aligned with the corresponding at least one aligning aperture of the slide card, and the article within the at least one blister is removable from the package.

6. The feature according to claim 5, wherein the first flap is integral with the slide card and delimited by a score line between the flap and the slide card, wherein the flap is folded over the score line onto the outside surface of the slide card.

7. The feature according to claim 1, wherein the stop panel is separate from the outer sleeve and is attached to the inside surface of the outer sleeve.

8. The feature according to claim 7, wherein the second end of the stop panel is spaced from a second end of the outer sleeve.

9. The feature according to claim 1, wherein the stop panel is integral with the outer sleeve and delimited by a score line between the stop panel and the outer sleeve, wherein the stop panel is folded over the score line onto the inside surface of the outer sleeve.

10. The feature according to claim 9, wherein the second end of the stop panel coincides with a second end of the outer sleeve.

11. The feature according to claim 1, wherein a second extension panel is connected to and extends away from the remaining portion of the first end of the stop panel parallel relative to the first extension panel, wherein the channel (C) is defined by a space between the two extension panels.

12. The feature according to claim 1, further comprising a gripping aperture provided within the outer sleeve and disposed proximate a second end opposite from and substantially parallel to the first end of the outer sleeve, wherein the gripping aperture provides a user access to a second end of the slide card that is opposite from and substantially parallel to the first end of the slide card to slide the slide card within the outer sleeve.

13. The feature according to claim 1, further comprising a cover panel, and a hinge panel between a first side of the outer sleeve and the cover panel, wherein the hinge panel is attached to the first side of the outer sleeve at a first side of the hinge panel and the hinge panel is connected to a first side of the cover panel at a second side of the hinge panel, wherein the cover panel is foldable over the outer sleeve at the hinge panel.

14. The feature according to claim 1, further comprising:

a second flap opposite from and substantially parallel to the first flap of the slide card, wherein the second flap includes a lock; and a lock aperture is provided within the outer sleeve between a second end of the outer sleeve and the at least one blister pocket receiving aperture, wherein the second end of the outer sleeve is opposite from and substantially parallel to the first end of the outer sleeve, and wherein the lock aperture provides a user access to the lock, and wherein the lock can be disengaged to permit the slide card to slide within the outer sleeve.

15. The feature according to claim 14, further comprising a gripping aperture provided within the outer sleeve and disposed proximate the second end of the outer sleeve, wherein the gripping aperture provides a user access to the second end of the flap to slide the slide card within the outer sleeve.

16. The feature according to claim 15, wherein the lock aperture is provided between the gripping aperture and the at least one blister receiving pocket aperture.

17. The feature according to claim 16, wherein the stop panel further comprises a lock stop that encompasses the lock aperture and has a stop edge proximate the second end of the outer sleeve and remote from the first end of the outer sleeve, wherein the lock stop engages the lock in a locked state.

18. The feature according to claim 17, wherein the second flap of the slide card is provided at a second end of the slide card, the second flap having a first end that coincides with the second end of the slide card and a second end opposite from and substantially parallel to the first end of the second flap of the slide card, and wherein the lock is attached to the second end of the second flap of the slide card at a first end of the lock.

19. The feature according to claim 18, wherein the lock has a second end opposite from and substantially parallel to the first end of the lock, and wherein the second end of the lock engages the lock stop in the locked state.

20. The feature according to claim 18, wherein between the first end of the lock and the second end of the second flap of the slide card is a score line about which the lock is folded, and wherein the lock can be biased toward the slide card when depressed by the user to disengage the lock from the lock stop and place the lock in an unlocked state.

21. The feature according to claim 14, further comprising a cover panel, and a hinge panel between a first side of the outer sleeve and the cover panel, wherein the hinge panel is attached to the first side of the outer sleeve at a first side of the hinge panel and the hinge panel is connected to a first side of the cover panel at a second side of the hinge panel, wherein the cover panel is foldable over the outer sleeve at the hinge panel.

22. A package comprising:

an outer sleeve having a first end and a second end opposite from and substantially parallel to the first end, the outer sleeve being formed from a flat, substantially rectangular shaped single blank having a first panel separated from a second panel by a first outer sleeve score line, the first outer sleeve score line enabling the second panel to be folded over the first panel, the first panel having a gripping aperture and at least one blister pocket receiving aperture and the second panel having a gripping aperture corresponding to the gripping aperture of the first panel and at least one exit aperture corresponding to the at least one blister pocket receiving aperture of the first panel;

a stop panel disposed on an inner surface of the second panel of the outer sleeve, the stop panel having a first end and a second end opposite and substantially parallel to the first end;

a stop panel edge defined by a portion of the first end of the stop panel;

an extension panel connected to and extending away from a remaining portion of the first end of the stop panel;

a guide panel extending along a longitudinal edge of the outer sleeve and having a length equal to or greater than a combined length of the stop panel and extension panel, wherein the guide panel is folded over the extension panel;

a channel (C) defined by an edge of the extension panel and the first outer sleeve score line; and a slide card which travels through the channel (C).

23. The package according to claim 22, wherein the slide card has a first end and a second end opposite from and substantially parallel to the first end of the slide card, the slide card being formed from a single blank having a first slide panel separated from a second slide panel by a first slide card score line, the first slide card score line enabling the second slide panel to be folded over the first slide panel, the first and second slide panels having at least one aligning aperture and a first flap on an outside surface of the second slide panel, the first flap having a raised flap edge at a first end of the slide card, wherein the raised flap edge may travel across a sliding distance (M) defined by the relationship $L>M\geqq 0$, wherein when the raised flap edge engages the stop panel edge, the sliding distance is defined by the relationship $M=0$, the slide card is prevented from further sliding within the outer sleeve, the at least one blister pocket receiving aperture and at least one exit aperture of the outer sleeve are aligned with the corresponding at least one aligning aperture of the slide card, and the article within the at least one blister is removable from the package.

24. The package according to claim 22, wherein the guide panel completely covers the extension panel and partially covers the stop panel.

25. The package according to claim 22, wherein the extension panel is integral with the stop panel.

26. The package according to claim 22, wherein the guide panel is integral with the second panel of the outer sleeve.

27. The package according to claim 22, wherein the stop panel is separate from the second panel of the outer sleeve and is attached to the inside surface of the second panel of the outer sleeve and a second end of the stop panel opposite from and substantially parallel to the first end of the stop panel is spaced from the second end of the outer sleeve.

28. The package according to claim 27, wherein the lock aperture is provided between the gripping aperture and the at least one blister receiving pocket aperture.

29. The package according to claim 27, wherein the stop panel further comprises a lock stop that encompasses the lock aperture and has a stop edge proximate the second end of the outer sleeve and remote from the first end of the outer sleeve, wherein the lock stop engages the lock in a locked state.

30. The package according to claim 22, wherein the stop panel is integral with the second panel of the outer sleeve and delimited by a stop panel score line between the stop panel and the second panel of the outer sleeve, wherein the stop panel is folded over the stop panel score line onto the inside surface of the second panel of the outer sleeve, and wherein a second end of the stop panel opposite from and substantially parallel to the first end of the stop panel coincides with the second end of the second panel of the outer sleeve.

31. The package according to claim 22, wherein the first flap is integral with the slide card and delimited by a first flap score line between the first flap and the second slide panel of the slide card, wherein the flap is folded over the first flap score line onto the outside surface of the second slide panel of the slide card.

32. The package according to claim 31, wherein the second flap of the slide card is provided at the second end of the slide card, the second flap having a first end that coincides with the second end of the slide card and a second end opposite from and substantially parallel to the first end of the second flap of the slide card, and wherein the lock is attached to the second end of the second flap of the slide card at a first end of the lock.

33. The package according to claim 22, further comprising a cover panel, and a hinge panel between a first side of the outer sleeve and the cover panel, wherein the hinge panel is attached to the first side of the outer sleeve at a first side of the hinge panel and the hinge panel is connected to a first side of the cover panel at a second side of the hinge panel, wherein the cover panel is foldable over the outer sleeve at the hinge panel.

34. The package according to claim 33, wherein the lock has a second end opposite from and substantially parallel to the first end of the lock, and wherein the second end of the lock engages the lock stop in the locked state.

35. The package according to claim 22, further comprising:

a second flap opposite from and substantially parallel to the first flap of the slide card, wherein the second flap includes a lock; and a lock aperture is provided within the second panel of the outer sleeve between the second end of the outer sleeve and the at least one blister pocket receiving aperture, wherein the lock aperture provides a user access to the lock, and wherein the lock can be disengaged to permit the slide card to slide within the outer sleeve.

36. The package according to claim 35, wherein between the first end of the lock and the second end of the second flap of the slide card is a lock score line about which the lock is folded, and wherein the lock can be biased toward the slide card when depressed by the user to disengage the lock from the lock stop and place the lock in an unlocked state.

* * * * *

UNITED STATES PATENT AND TRADEMARK OFFICE

CERTIFICATE OF CORRECTION

PATENT NO. : 7,201,274 B2
APPLICATION NO. : 10/880464
DATED : April 10, 2007
INVENTOR(S) : Michael Paliotta et al.

It is certified that error appears in the above-identified patent and that said Letters Patent is hereby corrected as shown below:

Title Page

Item (56), References Cited, U.S. Patent Documents, please change

"6,484,580 B2 * 11/2002 Eagen et al." to

-- 6,848,580 B2 * 2/2005 Paliotta et al. --

Signed and Sealed this

Twelfth Day of June, 2007

JON W. DUDAS
*Director of the United States Patent and Trademark Office*